US009921503B2

(12) United States Patent
Yamada et al.

(10) Patent No.: US 9,921,503 B2
(45) Date of Patent: Mar. 20, 2018

(54) TONER, DEVELOPER, AND IMAGE FORMATION DEVICE

(71) Applicants: Hiroshi Yamada, Shizuoka (JP); Tsuyoshi Sugimoto, Shizuoka (JP); Susumu Chiba, Shizuoka (JP); Shinsuke Nagai, Shizuoka (JP); Kohsuke Nagata, Shizuoka (JP); Shinya Nakayama, Shizuoka (JP); Yuka Mizoguchi, Shizuoka (JP); Suzuka Amemori, Shizuoka (JP)

(72) Inventors: Hiroshi Yamada, Shizuoka (JP); Tsuyoshi Sugimoto, Shizuoka (JP); Susumu Chiba, Shizuoka (JP); Shinsuke Nagai, Shizuoka (JP); Kohsuke Nagata, Shizuoka (JP); Shinya Nakayama, Shizuoka (JP); Yuka Mizoguchi, Shizuoka (JP); Suzuka Amemori, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/122,087

(22) PCT Filed: Jan. 6, 2015

(86) PCT No.: PCT/JP2015/050111
§ 371 (c)(1),
(2) Date: Aug. 26, 2016

(87) PCT Pub. No.: WO2015/129289
PCT Pub. Date: Sep. 3, 2015

(65) Prior Publication Data

US 2017/0017175 A1 Jan. 19, 2017

(30) Foreign Application Priority Data

Feb. 26, 2014 (JP) ..... 2014-034929
Aug. 4, 2014 (JP) ..... 2014-158777
Dec. 5, 2014 (JP) ..... 2014-247194

(51) Int. Cl.
*G03G 9/08* (2006.01)
*G03G 9/087* (2006.01)
(Continued)

(52) U.S. Cl.
CPC ..... *G03G 9/08755* (2013.01); *G03G 9/0806* (2013.01); *G03G 9/08793* (2013.01);
(Continued)

(58) Field of Classification Search
CPC ..... G03G 9/08755; G03G 9/08793; G03G 9/08795; G03G 9/08797
(Continued)

(56) References Cited

U.S. PATENT DOCUMENTS 7,374,851 B2 5/2008 Nakayama et al.
8,084,176 B2 12/2011 Iwamoto et al.
(Continued)

FOREIGN PATENT DOCUMENTS

JP 2579150 11/1996
JP 11-133665 5/1999
(Continued)

OTHER PUBLICATIONS

Extended Search Report dated Feb. 6, 2017 in European Patent Application No. 15754698.7.
(Continued)

*Primary Examiner* — Mark A Chapman
(74) *Attorney, Agent, or Firm* — Oblon, McClelland, Maier & Neustadt, L.L.P.

(57) ABSTRACT

A toner including: a pigment; polyester resin A that is insoluble in tetrahydrofuran (THF); and polyester resin B that is soluble in THF, wherein the toner satisfies requirements (1) to (3) below:
(Continued)

(1) the polyester resin A includes one or more aliphatic diols including from 3 through 10 carbon atoms, as a component constituting the polyester resin A;
(2) the polyester resin B includes at least an alkylene glycol in an amount of 40 mol % or more, as a component constituting the polyester resin B; and
(3) a glass transition temperature (Tg1st) of the toner at first heating in differential scanning calorimetry (DSC) of the toner is from 20° C. through 50° C.

17 Claims, 3 Drawing Sheets

(51) Int. Cl.
*G03G 9/09* (2006.01)
*G03G 15/08* (2006.01)

(52) U.S. Cl.
CPC ..... *G03G 9/08795* (2013.01); *G03G 9/08797* (2013.01); *G03G 9/0904* (2013.01); *G03G 15/08* (2013.01)

(58) Field of Classification Search
USPC ..... 430/109.4
See application file for complete search history.

(56) References Cited

U.S. PATENT DOCUMENTS

| | | | |
|---|---|---|---|
| 8,673,528 | B2 | 3/2014 | Sugimoto et al. |
| 2005/0112488 | A1 | 5/2005 | Yamada et al. |
| 2006/0177756 | A1 | 8/2006 | Sugimoto et al. |
| 2008/0070151 | A1 | 3/2008 | Sugimoto et al. |
| 2008/0118855 | A1 | 5/2008 | Nakayama et al. |
| 2008/0233498 | A1 | 9/2008 | Yamada et al. |
| 2008/0261131 | A1 | 10/2008 | Nakayama et al. |
| 2008/0268366 | A1 | 10/2008 | Nakayama et al. |
| 2008/0280219 | A1 | 11/2008 | Nakayama et al. |
| 2008/0318143 | A1 | 12/2008 | Nakayama et al. |
| 2008/0318148 | A1 | 12/2008 | Sugimoto et al. |
| 2009/0092917 | A1 | 4/2009 | Sugimoto et al. |
| 2009/0214973 | A1 | 8/2009 | Sugimoto et al. |
| 2009/0325099 | A1 | 12/2009 | Watanabe et al. |
| 2010/0035170 | A1 | 2/2010 | Sugimoto et al. |
| 2010/0075245 | A1 | 3/2010 | Watanabe et al. |
| 2011/0281213 | A1 | 11/2011 | Sakashita et al. |
| 2012/0064447 | A1 | 3/2012 | Hozumi et al. |
| 2012/0065357 | A1 | 3/2012 | Yamauchi et al. |
| 2012/0082926 | A1 | 4/2012 | Suzuki et al. |
| 2012/0122027 | A1 | 5/2012 | Watanabe et al. |
| 2012/0219896 | A1 | 8/2012 | Asahina et al. |
| 2012/0282000 | A1 | 11/2012 | Nakayama et al. |
| 2012/0295193 | A1 | 11/2012 | Hanatani et al. |
| 2013/0045442 | A1 | 2/2013 | Moriya et al. |
| 2013/0059247 | A1 | 3/2013 | Sugimoto et al. |
| 2013/0078563 | A1 | 3/2013 | Nakayama et al. |
| 2013/0095422 | A1 | 4/2013 | Yamamoto et al. |
| 2013/0108950 | A1 | 5/2013 | Yamamoto et al. |
| 2013/0115550 | A1 | 5/2013 | Amemori et al. |
| 2013/0143155 | A1 | 6/2013 | Santo et al. |
| 2013/0157183 | A1 | 6/2013 | Santo et al. |
| 2013/0157185 | A1 | 6/2013 | Sakashita et al. |
| 2013/0157193 | A1 | 6/2013 | Moritani et al. |
| 2013/0196260 | A1 | 8/2013 | Yoshida et al. |
| 2013/0236826 | A1 | 9/2013 | Makabe et al. |
| 2013/0244011 | A1 | 9/2013 | Sabu et al. |
| 2013/0244153 | A1 | 9/2013 | Nakayama et al. |
| 2013/0244154 | A1 | 9/2013 | Yamamoto et al. |
| 2013/0244168 | A1 | 9/2013 | Yamashita et al. |
| 2013/0252158 | A1 | 9/2013 | Yamada et al. |
| 2013/0260298 | A1 | 10/2013 | Amemori et al. |
| 2013/0337374 | A1 | 12/2013 | Sugimoto et al. |
| 2014/0023965 | A1 | 1/2014 | Chiba et al. |
| 2014/0051019 | A1 | 2/2014 | Sekiguchi et al. |
| 2014/0065534 | A1 | 3/2014 | Amemori et al. |
| 2014/0080046 | A1 | 3/2014 | Asahina et al. |
| 2014/0080050 | A1 | 3/2014 | Asahina et al. |
| 2014/0099578 | A1 | 4/2014 | Hotta et al. |
| 2014/0242514 | A1 | 8/2014 | Inoue et al. |
| 2014/0270874 | A1 | 9/2014 | Hase et al. |
| 2014/0272689 | A1 | 9/2014 | Yamashita et al. |
| 2014/0272695 | A1 | 9/2014 | Moritani et al. |
| 2014/0272698 | A1 | 9/2014 | Yamada et al. |
| 2014/0301757 | A1 | 10/2014 | Sakashita et al. |
| 2014/0342283 | A1 | 11/2014 | Yamamoto et al. |

FOREIGN PATENT DOCUMENTS

| | | |
|---|---|---|
| JP | 2001-158819 | 6/2001 |
| JP | 2002-287400 | 10/2002 |
| JP | 2002-351143 | 12/2002 |
| JP | 2004-046095 | 2/2004 |
| JP | 2007-271789 | 10/2007 |
| JP | 2012-063417 | 3/2012 |
| JP | 2012-118499 | 6/2012 |
| JP | 2012-194515 | 10/2012 |
| JP | 2013-088686 | 5/2013 |
| JP | 2013-156522 | 8/2013 |
| JP | 5408210 B | 11/2013 |
| JP | 2015-052697 | 3/2015 |
| JP | 2015-052698 | 3/2015 |
| JP | 2015-072467 | 4/2015 |
| KR | 10-0172199 B1 | 3/1999 |
| WO | WO 2013/190828 A1 | 12/2013 |

OTHER PUBLICATIONS

International Search Report dated Mar. 3, 2015 for counterpart International Patent Application No. PCT/JP2015/050111 filed Jan. 6, 2015.
U.S. Appl. No. 14/913,606, filed Feb. 22, 2016.
U.S. Appl. No. 14/914,291, filed Feb. 25, 2016.
U.S. Appl. No. 14/916,911, filed Mar. 4, 2016.
Korean Office Action dated Nov. 18, 2017, in Korean Patent Application No. 10-2016-7026631 (with English Translation).

TONER, DEVELOPER, AND IMAGE FORMATION DEVICE

TECHNICAL FIELD

The present invention relates to a toner, a developer using the toner, and an image forming apparatus using the toner.

BACKGROUND ART

In recent years, toners have been required to have the following properties: i.e., a smaller particle diameter and hot offset resistance for giving higher quality to output images; low-temperature fixing ability for energy saving; and heat-resistant storage stability for enduring a high-temperature, high-humidity environment during storage or transportation after production. In particular, improvement in low-temperature fixing ability is very important because power consumption for fixing occupies a large part of power consumption for the entire image forming process.

Hitherto, toners produced by a kneading and pulverizing method have been used. However, the toners produced by the kneading and pulverizing method have the following problems: their particle diameter is difficult to reduce; their amorphous shape and broad particle diameter distribution result in unsatisfactory quality of output images; and a large quantity of energy is required for fixing. When a wax (i.e., a release agent) is added to the toner in the kneading and pulverizing method for the purpose of improving a fixing ability, a large amount of the wax is present on toner surfaces because the kneaded product is cracked at an interface with the wax during pulverization. As a result, although a release effect is exhibited, the toner tends to deposit on a carrier, a photoconductor, and a blade (i.e., filming). Therefore, there is a problem that the toner is unsatisfactory from the viewpoint of performances as a whole.

In order to overcome the above-described problems associated with the kneading and pulverizing method, there has been proposed a method for producing a toner by a polymerization method. The toner produced by the polymerization method can be easily made to have a smaller particle diameter, can have a sharper particle size distribution than the toner produced by the kneading and pulverizing method, and can encapsulate a release agent. As the method for producing a toner by the polymerization method, there has been disclosed a method for producing a toner using an elongation reaction product of urethane-modified polyester as a toner binder, for the purpose of improving the low-temperature fixing ability and the hot offset resistance (see, for example, Patent document 1).

Moreover, there has been disclosed a method for producing a toner which is excellent in all of the heat-resistant storage stability, the low-temperature fixing ability, and the hot offset resistance, as well as excellent in powder flowability and transfer ability when the toner has a small particle diameter (see, for example, Patent documents 2 and 3). Furthermore, there has been disclosed a method for producing a toner, the method including an aging step for the purposes of producing a toner binder having a stable molecular weight distribution and achieving both of the low-temperature fixing ability and the hot offset resistance (see, for example, Patent documents 4 and 5).

However, the above-described techniques are unsatisfactory from the viewpoint of achieving a high-level, low-temperature fixing ability which has been required in recent years.

For the purpose of achieving the low-temperature fixing ability at a high level, there has been proposed a toner which includes a release agent and a resin including a crystalline polyester resin and has a sea-island, phase-separated structure due to incompatibility between the resin and the wax (see, for example, Patent document 6). Moreover, there has been proposed a toner including a crystalline polyester resin, a release agent, and a graft polymer (see, for example, Patent document 7).

CITATION LIST

Patent Document

Patent document 1: Japanese Unexamined Patent Application Publication No. 11-133665
Patent document 2: Japanese Unexamined Patent Application Publication No. 2002-287400
Patent document 3: Japanese Unexamined Patent Application Publication No. 2002-351143
Patent document 4: Japanese Patent No. 2579150
Patent document 5: Japanese Unexamined Patent Application Publication No. 2001-158819
Patent document 6: Japanese Unexamined Patent Application Publication No. 2004-46095
Patent document 7: Japanese Unexamined Patent Application Publication No. 2007-271789

SUMMARY OF THE INVENTION

Technical Problem

The present invention aims to solve the above existing problems and provide a toner being excellent in low-temperature fixing ability, hot offset resistance, heat-resistant storage stability, and moisture-and-heat-resistant storage stability, as well as image gloss.

Solution to Problem

Means for solving the above problems is as follows.

That is, a toner of the present invention includes at least a pigment, polyester resin A that is insoluble in tetrahydrofuran (THF), and polyester resin B that is soluble in THF. The toner satisfies requirements (1) to (3) below.

(1) The polyester resin A includes one or more aliphatic diols including from 3 through 10 carbon atoms, as a component constituting the polyester resin A.

(2) The polyester resin B includes at least an alkylene glycol in an amount of 40 mol % or more, as a component constituting the polyester resin B.

(3) A glass transition temperature (Tg1st) of the toner at first heating in differential scanning calorimetry (DSC) of the toner is from 20° C. through 50° C.

Effects of the Invention

According to the present invention, it is possible to solve the above existing problems and provide a toner being excellent in low-temperature fixing ability, hot offset resistance, and heat-resistant storage stability, as well as image gloss.

Figure 1:
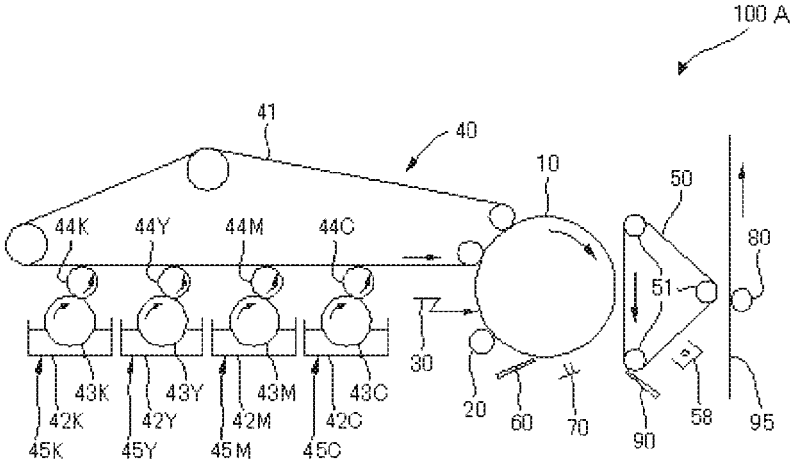
FIG. 1 is a schematic, configurational view illustrating one exemplary image forming apparatus according to the present invention.

MODE FOR CARRYING OUT THE INVENTION (Toner)

A toner of the present invention includes at least a pigment and two kinds of polyester resins A and B and satisfies the requirements (1) to (3), as described above.

For the purpose of improving low-temperature fixing ability, an approach that can be considered is to decrease glass transition temperatures (Tgs) or molecular weights of the polyester resins A and B so that the polyester resins A and B are eutectic with a crystalline polyester resin. However, it is easily conceivable that when the Tgs or the molecular weights of the polyester resins A and B are simply decreased to decrease a melt viscosity, the toner is deteriorated in heat-resistant storage stability and hot offset resistance during fixing.

In contrast, polyester resin A, which is insoluble in tetrahydrofuran (THF), in the toner of the present invention includes a diol component as a constituting component. The diol component includes one or more aliphatic diols including from 3 through 10 carbon atoms. As a result, the Tg and the melt viscosity are decreased to enable the low-temperature fixing ability to be secured. Moreover, the polyester resin A includes a trivalent or higher aliphatic alcohol as a cross-linking component. As a result, the polyester resin A has a branched structure in a molecular backbone to form a molecular chain having a three-dimensional network structure. Thus, the polyester resin A has a rubber-like property, in other words, the polyester resin A deforms at a low temperature but does not flow, making it possible for the toner to retain the heat-resistant storage stability and the hot offset resistance.

Trivalent or higher carboxylic acids or epoxy compounds can also be used as the cross-linking component for the polyester resin A. When using the carboxylic acids, however, fixed images produced by fixing of a toner with heat may exhibit unsatisfactory glossiness because many carboxylic acids are aromatic compounds or the density of ester bonds in cross-linked portions becomes higher. Meanwhile, when using a cross-linking agent such as the epoxy compounds, the polyester should be subjected to a cross-linking reaction after polymerization. As a result, a distance between cross-linked points is difficult to control, the desired viscoelasticity cannot be achieved, and the epoxy compounds tend to react with oligomers formed during production of the polyester to form moieties having a high cross-linking density, potentially resulting in uneven fixed images being poor in image density or glossiness.

<Tetrahydrofuran (THF)-Insoluble Polyester Resin A>

The polyester resin A includes a diol component and a cross-linking component as constituting components, and preferably further includes a dicarboxylic acid component.

The diol component includes one or more aliphatic diols including from 3 through 10 carbon atoms, and an amount of the one or more aliphatic diols included is preferably 50 mol % or more, more preferably 80 mol % or more.

Examples of the aliphatic diols including from 3 through 10 carbon atoms include 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol.

The diol component of the polyester resin A preferably includes a main chain portion including an odd number of carbon atoms, and an alkyl group in a side chain. Similarly, the aliphatic diols including from 3 through 10 carbon atoms also preferably have a structure represented by General Formula (1) below:

$$HO—(CR^1R^2)_n—OH \qquad \text{General Formula (1)}$$

where $R^1$ and $R^2$ each independently denote a hydrogen atom or an alkyl group including from 1 through 3 carbon atoms, and n denotes an odd number within a range of from 3 through 9. $R^1$ and $R^2$ may be identical to or different from each other in the n repeated units.

As described above, the cross-linking component of the polyester resin A includes a trivalent or higher aliphatic alcohol. The cross-linking component of the polyester resin A preferably includes a trivalent or tetravalent aliphatic alcohol from the viewpoint of glossiness and image density of the fixed images. The cross-linking component may be the trivalent or higher aliphatic alcohol alone. Examples of the trivalent or higher aliphatic alcohol include glycerin, trimethylolethane, trimethylolpropane, pentaerythritol, sorbitol, and dipentaerythritol.

A rate of the cross-linking component in the components constituting the polyester resin A is not particularly limited and may be appropriately selected depending on the intended purpose, but is preferably 0.5% by mass to 5% by mass, more preferably 1% by mass to 3% by mass.

A rate of the trivalent or higher aliphatic alcohol in the polyvalent alcohol components serving as the component of the polyester resin A is not particularly limited and may be appropriately selected depending on the intended purpose, but is preferably 50% by mass to 100% by mass, more preferably 90% by mass to 100% by mass.

The dicarboxylic component in the polyester resin A includes an aliphatic dicarboxylic acid including from 4 through 12 carbon atoms, and an amount of the aliphatic dicarboxylic acid included is preferably 50 mol % or more.

Examples of the aliphatic dicarboxylic acids including from 4 through 12 carbon atoms include succinic acid, glutaric acid, adipic acid, pimelic acid, suberic acid, azelaic acid, sebacic acid, and dodecane diacid.

The polyester resin A includes at least one of a urethane bond and a urea bond from the viewpoint of realizing more excellent adhesion onto recording media such as paper. The urethane bond or the urea bond behaves like a pseudo-cross-linking point to enhance a rubber-like property of the polyester resin A, leading to more excellent heat-resistant storage stability and more excellent hot offset resistance of the toner.

A glass transition temperature (Tg1st) of the toner of the present invention at the first heating in differential scanning calorimetry (DSC) can be adjusted to fall within the desired range by varying a component ratio of the aliphatic diol and the dicarboxylic acid component in the polyester resin A, a glass transition temperature of the polyester resin B, and a component ratio between the polyester resin A and the polyester resin B.

<Tetrahydrofuran (THF)-Soluble Polyester Resin B>

In the present invention, the polyester resin A and the polyester resin B are used in combination.

The polyester resin B includes a diol component and a dicarboxylic acid component as constituting components. The polyester resin B includes at least an alkylene glycol in an amount of 40 mol % or more.

The polyester resin B may or may not include a cross-linking component as the constituting component.

A Tg of the polyester resin B is preferably from 40° C. through 80° C., but may be appropriately selected depending on the intended purpose.

The polyester resin B is preferably a linear polyester resin.

Also, the polyester resin B is preferably an unmodified polyester resin. The unmodified polyester resin refers to a polyester resin being obtained from polyvalent alcohol and polyvalent carboxylic acid or derivatives of the polyvalent carboxylic acids (e.g., polyvalent carboxylic acids, polyvalent carboxylic acid anhydrides, and polyvalent carboxylic acid esters) and not being modified with, for example, an isocyanate compound.

Examples of the polyvalent alcohol include diols.

Examples of the diols include adducts of bisphenol A with alkylene (including from 2 through 3 carbon atoms) oxide (with from 1 mole to 10 moles being added on average) such as polyoxypropylene(2.2)-2,2-bis(4-hydroxyphenyl)propane and polyoxyethylene(2.2)-2,2-bis(4-hydroxyphenyl) propane; ethylene glycol and propylene glycol; and hydrogenated bisphenol A and adducts of hydrogenated bisphenol A with alkylene (including from 2 through 3 carbon atoms) oxide (with from 1 mole to 10 moles being added on average).

These diols may be used alone or in combination.

Examples of the polyvalent carboxylic acids include dicarboxylic acids.

Examples of the dicarboxylic acids include adipic acid, phthalic acid, isophthalic acid, terephthalic acid, fumaric acid, maleic acid; and succinic acid substituted with alkyl groups including from 1 through 20 carbon atoms or alkenyl groups including from 2 through 20 carbon atoms (e.g., dodecenylsuccinic acid and octylsuccinic acid). It is preferable to include 50 mol % or more of terephthalic acid especially from the viewpoint of the heat-resistant storage stability.

These dicarboxylic acids may be used alone or in combination.

In order to adjust an acid value or a hydroxyl value of the polyester resin B, the polyester resin B may include at least one of trivalent or higher carboxylic acids and trivalent or higher alcohols at chain ends of the polyester resin B.

Examples of the trivalent or higher carboxylic acids include trimellitic acid, pyromellitic acid, and acid anhydrides thereof.

Examples of the trivalent or higher alcohols include glycerin, pentaerythritol, and trimethylolpropane.

A molecular weight of the polyester resin B is not particularly limited and may be appropriately selected depending on the intended purpose. When the molecular weight is too low, the resultant toner may be poor in heat-resistant storage stability and durability to stress such as stirring in a developing device. When the molecular weight is too high, the resultant toner may be increased in viscoelasticity upon melting to be poor in low-temperature fixing ability. When an amount of a component having a molecular weight of 600 or less is too large, the resultant toner may be poor in heat-resistant storage stability and durability to stress such as stirring in a developing device. When the amount of the component having a molecular weight of 600 or less is too small, the resultant toner may be poor in low-temperature fixing ability. Therefore, in gel permeation chromatography (GPC) measurement, the polyester resin B preferably has a weight average molecular weight (Mw) of from 3,000 through 10,000 and a number average molecular weight (Mn) of from 1,000 through 4,000. A Mw/Mn is preferably from 1.0 through 4.0.

The component having a molecular weight of 600 or less in the THF-soluble matter is preferably included in an amount of from 2% by mass through 10% by mass. The polyester resin B may be purified by extraction with methanol to remove the component having a molecular weight of 600 or less.

The weight average molecular weight (Mw) is more preferably from 4,000 through 7,000. The number average molecular weight (Mn) is more preferably from 1,500 through 3,000. The Mw/Mn is more preferably from 1.0 through 3.5.

An acid value of the polyester resin B is not particularly limited and may be appropriately selected depending on the intended purpose, but is preferably from 1 mgKOH/g through 50 mgKOH/g, more preferably from 5 mgKOH/g through 30 mgKOH/g. When the acid value is 1 mgKOH/g or more, the resultant toner tends to be negatively charged and thus can have a higher affinity with paper during fixing and an improved low-temperature fixing ability. When the acid value is more than 50 mgKOH/g, the resultant toner may be deteriorated in charging stability, especially charging stability to environmental changes.

A hydroxyl value of the polyester resin B is not particularly limited and may be appropriately selected depending on the intended purpose, but is preferably 5 mgKOH/g or more.

A Tg of the polyester resin B is preferably from 40° C. through 80° C., more preferably from 50° C. through 70° C. When the Tg is lower than 40° C., the resultant toner is poor in heat-resistant storage stability and durability to stress such as stirring in a developing device, and also is deteriorated in filming resistance. When the Tg is higher than 80° C., the resultant toner insufficiently deforms with heating and pressing during fixing, leading to unsatisfactory low-temperature fixing ability.

An amount of the polyester resin B is not particularly limited and may be appropriately selected depending on the intended purpose, but is preferably from 50 parts by mass through 90 parts by mass, more preferably from 60 parts by mass through 80 parts by mass, relative to 100 parts by mass of the toner. When the amount of the polyester resin B is less than 50 parts by mass, dispersibility of a pigment and a release agent in the toner is deteriorated, potentially easily causing fogging on images and formation of abnormal images. When the amount of the polyester resin B is more than 90 parts by mass, the amounts of the crystalline polyester resin and the polyester resin A are decreased, and the resultant toner may be poor in low-temperature fixing ability. The amount of the polyester resin B falling within the above more preferable range is advantageous from the viewpoint of high image quality and excellent low-temperature fixing ability.

The diol component and the dicarboxylic acid component used for the polyester resins A and B will now be described.

—Diol Component—

The diol component is not particularly limited and may be appropriately selected depending on the intended purpose. Examples of the diol component include aliphatic diols such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; diols including an oxyalkylene group such as diethylene glycol, triethylene glycol, dipropylene glycol, polyethylene glycol, polypropylene glycol, and polytetramethylene glycol; alicyclic diols such as 1,4-cyclohexanedimethanol and hydrogenated bisphenol A; adducts of alicyclic diols with alkylene oxides such as ethylene oxide, propylene oxide, and butylene oxide; bisphenols such as bisphenol A, bisphenol F, and bisphenol S; and adducts of bisphenols with alkylene oxides such as those obtained by adding alkylene oxides such as ethylene oxide, propylene oxide, and butylene oxide to bisphenols. Among them, preferable are aliphatic diols including from 4 through 12 carbon atoms.

These diols may be used alone or in combination.

—Dicarboxylic Acid Component—

The dicarboxylic acid component is not particularly limited and may be appropriately selected depending on the intended purpose. Examples of the dicarboxylic acid component include aliphatic dicarboxylic acids and aromatic dicarboxylic acids. Anhydrides, esterified products with lower alkyls (i.e., alkyls including from 1 through 3 carbon atoms), or halides of the aliphatic dicarboxylic acids and the aromatic dicarboxylic acids may also be used.

Examples of the aliphatic dicarboxylic acids include succinic acid, adipic acid, sebacic acid, dodecane diacid, maleic acid, and fumaric acid. Examples of the aromatic dicarboxylic acids include phthalic acid, isophthalic acid, terephthalic acid, and naphthalene dicarboxylic acids. Among them, preferable are aliphatic dicarboxylic acids including from 4 through 12 carbon atoms.

These dicarboxylic acids may be used alone or in combination.

—Trivalent or Higher Aliphatic Alcohol—

The trivalent or higher aliphatic alcohols are not particularly limited and may be appropriately selected depending on the intended purpose. Examples of the trivalent or higher aliphatic alcohols include glycerin, trimethylolethane, trimethylolpropane, pentaerythritol, sorbitol, and dipentaerythritol.

Among them, preferable are trivalent or tetravalent aliphatic alcohols. These trivalent or higher aliphatic alcohols may be used alone or in combination.

—Polyester Resin Including at Least One of Urethane Bond and Urea Bond—

The polyester resin including at least one of a urethane bond and a urea bond is not particularly limited and may be appropriately selected depending on the intended purpose. Examples of the polyester resin including at least one of a urethane bond and a urea bond include a reaction product between a polyester resin including an active hydrogen group and polyisocyanate. This reaction product is preferably used as a reaction precursor to be allowed to react with a curing agent described below (hereinafter may be referred to as "prepolymer").

Examples of the polyester resin including an active hydrogen group include polyester resins including a hydroxyl group.

—Polyisocyanate—

The polyisocyanate is not particularly limited and may be appropriately selected depending on the intended purpose. Examples of the polyisocyanate include diisocyanates and trivalent or higher isocyanates.

Examples of the diisocyanates include aliphatic diisocyanates, alicyclic diisocyanates, aromatic diisocyanates, aromatic aliphatic diisocyanates, isocyanurates, and blocked products of the above-listed diisocyanates with, for example, phenol derivatives, oximes, or caprolactams.

Examples of the aliphatic diisocyanates include tetramethylene diisocyanate, hexamethylene diisocyanate, methyl 2,6-diisocyanatocaproate, octamethylene diisocyanate, decamethylene diisocyanate, dodecamethylene diisocyanate, tetradecamethylene diisocyanate, trimethylhexane diisocyanate, and tetramethylhexane diisocyanate.

Examples of the alicyclic diisocyanates include isophorone diisocyanate and cyclohexylmethane diisocyanate.

Examples of the aromatic diisocyanates include tolylene diisocyanate, diisocyanatodiphenylmethane, 1,5-nephthylene diisocyanate, 4,4'-diisocyanatodiphenyl, 4,4'-diisocyanato-3,3'-dimethyldiphenyl, 4,4'-diisocyanato-3-methyldiphenyldiphenylmethane, and 4,4'-diisocyanato-diphenyl ether.

Examples of the aromatic aliphatic diisocyanates include $\alpha,\alpha,\alpha',\alpha'$-tetramethylxylene diisocyanate.

Examples of the isocyanurates include tris(isocyanatoalkyl)isocyanurate and tris(isocyanatocycloalkyl)isocyanurate.

These polyisocyanates may be used alone or in combination.

——Curing Agent——

The curing agent is not particularly limited and may be appropriately selected depending on the intended purpose, so long as the curing agent can react with the prepolymer. Examples of the curing agent include active-hydrogen-group-including compounds.

————Active-Hydrogen-Group-Including Compound————

An active hydrogen group in the active-hydrogen-group-including compound is not particularly limited and may be appropriately selected depending on the intended purpose. Examples of the active hydrogen group include a hydroxyl group (e.g., an alcoholic hydroxyl group and a phenolic hydroxyl group), an amino group, a carboxyl group, and a mercapto group. These active hydrogen groups may be used alone or in combination.

The active-hydrogen-group-including compound is preferably an amine because the amine can form a urea bond.

Examples of the amine include diamines, trivalent or higher amines, amino alcohols, amino mercaptans, amino acids, and compounds obtained by blocking the amino group in the above-listed amines. These amines may be used alone or in combination.

Among them, diamines or mixtures of diamines and a small amount of trivalent or higher amines are preferable.

Examples of the diamines include aromatic diamines, alicyclic diamines, and aliphatic diamines. Examples of the aromatic diamines include phenylenediamine, diethyl toluene diamine, and 4,4'-diaminodiphenylmethane. Examples of the alicyclic diamines include 4,4'-diamino-3,3'-dimethyldicyclohexyl methane, diaminocyclohexane, and isophoronediamine. Examples of the aliphatic diamines include ethylene diamine, tetramethylenediamine, and hexamethylenediamine.

Examples of the trivalent or higher amines include diethylenetriamine and triethylenetetramine.

Examples of the amino alcohols include ethanol amine and hydroxyethyl aniline.

Examples of the amino mercaptans include aminoethyl mercaptan and aminopropyl mercaptan.

Examples of the amino acids include aminopropionic acid and aminocaproic acid.

Examples of the compounds include ketimine compounds in which the amino group is blocked with ketones (e.g., acetone, methyl ethyl ketone, and methyl isobutyl ketone) and oxazoline compounds.

A molecular structure of the polyester resins A and B can be identified by solution-state or solid-state NMR, X-ray diffraction, GC/MS, LC/MS, or IR spectroscopy. In one employable convenient method, one having no absorption based on δCH (out-of-plane bending vibration) of olefin at 965±10 $cm^{-1}$ and 990±10 $cm^{-1}$ in an infrared absorption spectrum is detected as the polyester resin.

<Crystalline Polyester Resin>

The crystalline polyester resin is thermofused at a temperature around the fixing onset temperature to rapidly decrease in viscosity because the crystalline polyester resin has crystallinity. Use of the crystalline polyester resin having the above-described property in combination with the polyester resins A and B forms a toner that maintains excellent heat-resistant storage stability up to a temperature just below a melt onset temperature due to the crystallinity, but rapidly decreases in the viscosity at the melt onset temperature due to melting of the crystalline polyester resin. Along with the rapid decrease in the viscosity due to the melting, the crystalline polyester resin is homogeneously mixed with the polyester resins A and B. Thus, both the crystalline polyester resin and the polyester resins A and B rapidly decrease in the viscosity to be fixed. This makes it possible to obtain a toner being excellent in heat-resistant storage stability and low-temperature fixing ability. In addition, the toner gives an excellent result in terms of a releasable width (the difference between a lowest fixing temperature and a temperature at which the hot offset resistance occurs).

The crystalline polyester resin is obtained from a polyvalent alcohol and a polyvalent carboxylic acid or derivatives of the polyvalent carboxylic acid (e.g., polyvalent carboxylic acids, polyvalent carboxylic acid anhydrides, and polyvalent carboxylic acid esters).

Note that, in the present invention, the crystalline polyester resin refers to those obtained from a polyvalent alcohol and a polyvalent carboxylic acid or derivatives of the polyvalent carboxylic acid (e.g., polyvalent carboxylic acids, polyvalent carboxylic acid anhydrides, and polyvalent carboxylic acid esters), as described above. Modified polyester resins, for example, the prepolymer and resins obtained by allowing the prepolymer to undergo at least one of a cross-linking reaction and an elongation reaction do not belong to the crystalline polyester resin.

—Polyvalent Alcohol—

The polyvalent alcohol is not particularly limited and may be appropriately selected depending on the intended purpose. Examples of the polyvalent alcohols include diols and trivalent or higher alcohols.

Examples of the diols include saturated aliphatic diols. Examples of the saturated aliphatic diols include straight-chain saturated aliphatic diols and branched-chain saturated aliphatic diols. Among them, straight-chain saturated aliphatic diols are preferable, and straight-chain saturated aliphatic diols including from 2 through 12 carbon atoms are more preferable. When the saturated aliphatic diols are the branched-chain saturated aliphatic diols, the crystalline polyester resin may be decreased in crystallinity and thus may be decreased in a melting point. When the number of carbon atoms in the saturated aliphatic diols is more than 12, such materials are practically difficult to obtain.

Examples of the saturated aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferable because the crystalline polyester resin has high crystallinity and excellent sharp melt property.

Examples of the trivalent or higher alcohols include glycerin, trimethylolethane, trimethylolpropane, and pentaerythritol. These trivalent or higher alcohols may be used alone or in combination.

—Polyvalent Carboxylic Acid—

The polyvalent carboxylic acid is not particularly limited and may be appropriately selected depending on the intended purpose. Examples of the polyvalent carboxylic acids include divalent carboxylic acids and trivalent or higher carboxylic acids.

Examples of the divalent carboxylic acids include saturated aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids, such as phthalic acid, isophthalic acid, terephthalic acid, naphthalene-2,6-dicarboxylic acid, malonic acid, and mesaconic acid. Anhydrides or esters with lower alkyls (i.e., alkyls having from 1 through 3 carbon atoms) of the above-listed divalent carboxylic acids may also be used.

Examples of the trivalent or higher carboxylic acids include 1,2,4-benzenetricarboxylic acid, 1,2,5-benzenetricarboxylic acid, 1,2,4-naphthalene tricarboxylic acid, anhydrides of the above-listed trivalent or higher carboxylic acids, and esters of the above-listed trivalent or higher carboxylic acids with lower alkyls (i.e., alkyls having from 1 through 3 carbon atoms).

The polyvalent carboxylic acid may include dicarboxylic acids including a sulfonic acid group and dicarboxylic acids including a double bond.

These may be used alone or in combination.

The crystalline polyester resin preferably includes straight-chain saturated aliphatic dicarboxylic acids including from 4 through 12 carbon atoms and straight-chain saturated aliphatic diols including from 2 through 12 carbon atoms. This is because the resultant toner has high crystallinity and excellent sharp melt property and thus is capable of exhibiting excellent low-temperature fixing ability.

The melting point of the crystalline polyester resin is not particularly limited and may be appropriately selected depending on the intended purpose, but is preferably from 60° C. through 80° C. When the melting point is less than 60° C., the crystalline polyester resin tends to melt at a low temperature, potentially leading to poor heat-resistant storage stability of the toner. When the melting point is more than 80° C., the crystalline polyester resin insufficiently melts with heat applied during fixing, potentially leading to poor low-temperature fixing ability of the toner.

A molecular weight of the crystalline polyester resin is not particularly limited and may be appropriately selected depending on the intended purpose. Although crystalline polyester resins having a sharp molecular weight distribution and a low molecular weight are excellent in low-temperature fixing ability, toners including a large amount of low-molecular-weight components have poor heat-resistant storage stability. Therefore, an o-dichlorobenzene soluble matter of the crystalline polyester resin preferably has a weight average molecular weight (Mw) of from 3,000 through 30,000, a number average molecular weight (Mn) of from 1,000 through 10,000, and a ratio Mw/Mn of from 1.0 through 10, as measured by GPC. More preferably, the weight average molecular weight (Mw) is from 5,000 through 15,000, the number average molecular weight (Mn) is from 2,000 through 10,000, and the Mw/Mn is from 1.0 through 5.0.

An acid value of the crystalline polyester resin is not particularly limited and may be appropriately selected depending on the intended purpose, but is preferably 5 mgKOH/g or more, more preferably 10 mgKOH/g or more, for the purpose of achieving a desired low-temperature fixing ability in terms of affinity between paper and resin. Meanwhile, the acid value is preferably 45 mgKOH/g or less for the purpose of improving the hot offset resistance.

A hydroxyl value of the crystalline polyester resin is not particularly limited and may be appropriately selected depending on the intended purpose, but is preferably from 0 mgKOH/g through 50 mgKOH/g, more preferably from 5 mgKOH/g through 50 mgKOH/g, for the purpose of achieving a desired low-temperature fixing ability and an excellent charging property.

A molecular structure of the crystalline polyester resin can be identified by solution-state or solid-state NMR, X-ray diffraction, GC/MS, LC/MS, or IR spectroscopy. In one employable convenient method, one having no absorption based on δCH (out-of-plane bending vibration) of olefin at 965±10 $cm^{-1}$ and 990±10 $cm^{-1}$ in an infrared absorption spectrum is detected as the second polyester resin.

An amount of the crystalline polyester resin is not particularly limited and may be appropriately selected depending on the intended purpose, but is preferably from 3 parts by mass through 20 parts by mass, more preferably from 5 parts by mass through 15 parts by mass, relative to 100 parts by mass of the toner. When the amount is less than 3 parts by mass, the crystalline polyester resin gives an insufficient sharp melt property, potentially leading to poor low-temperature fixing ability of the toner. When the amount is more than 20 parts by mass, the resultant toner may be deteriorated in heat-resistant storage stability, and image fogging may tend to occur. The amount falling within the more preferable range is advantageous in that the resultant toner is excellent in image quality and low-temperature fixing ability.

<Difference Between SP Values of Polyester Resin B and Crystalline Polyester Resin C>

It is preferable to satisfy an expression of 1.2<SPb−SPc<1.5, where SPb denotes a solubility parameter [$cal^{1/2}/cm^{3/2}$] of the polyester resin B and SPc denotes a solubility parameter [$cal^{1/2}/cm^{3/2}$] of the crystalline polyester resin C.

When the SPb−SPc is 1.5 or more, the crystalline polyester resin C tends to be oriented outwardly, potentially leading to deteriorated storage stability.

Meanwhile, when the SPb−SPc is 1.2 or less, the polyester resin B and the crystalline polyester resin C are homogeneously mixed in part, potentially leading to deteriorated storage stability.

The solubility parameter is represented by the square root of evaporation energy per unit volume and can be calculated using the Fedors method according to the equation:

$$\text{Solubility parameter}=(E/V)^{1/2}$$

where E denotes evaporation energy [cal/mol] and V denotes molar volume [$cm^3$/mol].

Here, the E and the V satisfy the following equation:

$$E=\Sigma\Delta ei \quad V=\Sigma\Delta vi$$

where Δei denotes evaporation energy of an atomic group and Δvi denotes molar volume of the atomic group (see, Imoto, Minoru, "SECCHAKU NO KISO RIRON," Kobunshi Kankokai, Chapter 5).

Note that, SP values presented in Tables 1-1 to 1-4 are calculated without taking terminal functional groups into account, and SP values of the polyester resin B are calculated without taking isocyanate groups into account.

<Other Components>

The toner of the present invention may include, in addition to the above-described components, other components such as release agents, colorants, charge control agents, external additives, flowability improving agents, cleaning improving agents, and magnetic materials, if necessary.

—Release Agent—

The release agent is not particularly limited and may be selected from those known in the art.

Examples of waxes serving as the release agent include natural waxes such as vegetable waxes (e.g., carnauba wax, cotton wax, Japan wax, and rice wax), animal waxes (e.g., bees wax and lanolin), mineral waxes (e.g., ozokerite and ceresine), and petroleum waxes (e.g., paraffin wax, microcrystalline wax, and petrolatum).

In addition to the natural waxes, synthetic hydrocarbon waxes (e.g., Fischer-Tropsch wax, polyethylene wax, and polypropylene wax) and synthetic waxes (e.g., ester wax, ketone wax, and ether wax) may be used.

Additionally, fatty acid amide compounds such as 12-hydroxystearic acid amide, stearic acid amide, phthalic anhydride imide, and chlorinated hydrocarbons; low-molecular-weight crystalline polymer resins such as polyacrylate homopolymers (e.g., poly-n-stearyl methacrylate and poly-n-lauryl methacrylate) and polyacrylate copolymers (e.g., copolymers of n-stearyl acrylate and ethyl methacrylate); and crystalline polymers having a long alkyl group as a side chain may be used.

Among them, hydrocarbon waxes such as paraffin wax, microcrystalline wax, Fischer-Tropsch wax, polyethylene wax, and polypropylene wax are preferable.

A melting point of the release agent is not particularly limited and may be appropriately selected depending on the intended purpose, but is preferably from 60° C. through 80° C. When the melting point is less than 60° C., the release agent tends to melt at a low temperature, potentially leading to poor heat-resistant storage stability of the toner. In the case where the melting point is more than 80° C., even when the resin melts to be in a fixing temperature range, the release agent insufficiently melts to cause fixing offset, potentially leading to partially lost images.

An amount of the release agent is not particularly limited and may be appropriately selected depending on the intended purpose, but is preferably from 2 parts by mass through 10 parts by mass, more preferably from 3 parts by mass through 8 parts by mass, relative to 100 parts by mass of the toner. When the amount is less than 2 parts by mass, the resultant toner may be deteriorated in hot offset resistance during fixing and low-temperature fixing ability. When the amount is more than 10 parts by mass, the resultant toner may be deteriorated in heat-resistant storage stability, and image fogging may tend to occur. The amount falling within the more preferable range is advantageous in that the image quality and the fixing stability can be improved.

—Colorant—

The colorant is not particularly limited and may be appropriately selected depending on the intended purpose. Examples of the colorant include carbon black, nigrosin dyes, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, and R), pigment yellow L, benzidine yellow (G and GR), permanent yellow (NCG), vulcan fast yellow (5G, R), tartrazine lake, quinoline yellow lake, anthrasan yellow BGL, isoindolinone yellow, colcothar, red lead, lead vermilion, cadmium red, cadmium mercury red, antimony vermilion, permanent red 4R, para-red, fiser red, parachloroorthonitro aniline red, lithol fast scarlet G, brilliant fast scarlet, brilliant carmine BS, permanent red (F2R, F4R, FRL, FRLL, and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is not particularly limited and may be appropriately selected depending on the intended purpose, but is preferably from 1 part by mass through 15 parts by mass, more preferably from 3 parts by mass through 10 parts by mass, relative to 100 parts by mass of the toner.

The colorant may be used as a masterbatch which is a composite of the colorant with a resin. Examples of the resin used for production of the masterbatch or kneaded together with the masterbatch include, in addition to the crystalline polyester resin, polymers of styrene or substituted styrene (e.g., polystyrene, poly-p-chlorostyrene, and polyvinyltoluene); styrene copolymers (e.g., styrene-p-chlorostyrene copolymers, styrene-propylene copolymers, styrene-vinyl toluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-methyl vinyl ketone copolymers, styrene-butadiene copolymers, styrene-isoprene copolymers, styrene-acrylonitrile-indene copolymers, styrene-maleic acid copolymers, and styrene-maleic acid ester copolymers); polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylate resins, rosin, modified rosin, terpene resins, aliphatic or alicyclic hydrocarbon resins, aromatic petroleum resins, chlorinated paraffin, and paraffin wax.

These may be used alone or in combination.

The masterbatch can be prepared by mixing and kneading the colorant with the resin for the masterbatch with high shear being applied. In the mixing and kneading, organic solvents may be used for the purpose of enhancing interaction between the colorant and the resin. A so-called flushing method is preferably used. In the flushing method, an aqueous paste including the colorant is mixed and kneaded with the resin and the organic solvent, the colorant is transferred to the resin, and then water and the organic solvent are removed. Use of the flushing method is preferable because a wet cake of the colorant is used as it is, and it is not necessary to dry the wet cake of the colorant. For the mixing and kneading, a high-shear disperser (e.g., a three-roll mill) is preferably used.

—Charge Control Agent—

The charge control agent is not particularly limited and may be appropriately selected depending on the intended purpose. Examples of the charge control agent include nigrosine dyes, triphenylmethane dyes, chrome-including metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluoroactive agents, metal salts of salicylic acid, and metal salts of salicylic acid derivatives. Specific examples of the charge control agent include BONTRON 03 (a nigrosine dye), BONTRON P-51 (a quaternary ammonium salt), BONTRON S-34 (a metal-including azo dye), E-82 (an oxynaphthoic acid-based metal complex), E-84 (a salicylic acid-based metal complex), and E-89 (a phenolic condensate) (all of which are available from ORIENT CHEMICAL INDUSTRIES CO., LTD); TP-302 and TP-415 (quaternary ammonium salt molybdenum complexes) (all of which are available from Hodogaya Chemical Co., Ltd.); LRA-901; LR-147 (a boron complex) (available from Japan Carlit Co., Ltd.); copper phthalocyanine; perylene; quinacridone; azo pigments; and polymeric compounds including a functional group such as a sulfonic acid group, a carboxyl group, and a quaternary ammonium salt.

An amount of the charge control agent is not particularly limited and may be appropriately selected depending on the intended purpose, but is preferably from 0.1 parts by mass through 10 parts by mass, more preferably from 0.2 parts by mass through 5 parts by mass, relative to 100 parts by mass of the toner. When the amount is more than 10 parts by mass, the resultant toner has an excessively high charging ability. As a result, a main effect of the charge control agent is reduced and electrostatic attractive force to a developing roller is increased, potentially leading to lower flowability of the developer or lower image density of the resultant image. These charge control agents may be melt-kneaded with the masterbatch and the resin and then dissolved and dispersed in the organic solvent. Alternatively, needless to say, the charge control agents may be directly added to the organic solvent to be dissolved and dispersed, or may be fixed on surfaces of toner particles after the toner particles are produced.

—External Additive—

The external additive is not particularly limited and may be appropriately selected depending on the intended purpose. Examples of the external additive include various particles, hydrophobized inorganic particles. Fatty acid metal salts (e.g., zinc stearate and aluminium stearate) and fluoropolymers may also be used.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, parium sulfate, barium carbonate, calcium carbonate, silicon carbide, and silicon nitride. Among them, silica and titanium dioxide are particularly preferable.

Examples of suitable additives include hydrophobized silica particles, hydrophobized titania particles, hydrophobized titanium oxide particles, and hydrophobized alumina particles. Examples of the silica particles include R972, R974, RX200, RY200, R202, R805, and R812 (all of which are available from Nippon Aerosil Co., Ltd.). Examples of the titania particles include P-25 (available from Nippon Aerosil Co., Ltd.); STT-30 and STT-65C-S (both of which are available from Titan Kogyo, Ltd.); TAF-140 (available from Fuji Titanium Industry Co., Ltd.); and MT-150W, MT-500B, MT-600B, and MT-150A (all of which are available from TAYCA CORPORATION).

Examples of the hydrophobized titanium oxide particles include T-805 (available from Nippon Aerosil Co., Ltd.); STT-30A and STT-65S-S (both of which are available from Titan Kogyo, Ltd.); TAF-500T and TAF-1500T (both of which are available from Fuji Titanium Industry Co., Ltd.); MT-100S and MT-100T (both of which are available from TAYCA CORPORATION); and IT-S (available from ISHIHARA SANGYO KAISHA, LTD.).

The hydrophobized oxide particles, the hydrophobized silica particles, the hydrophobized titania particles, and the hydrophobized alumina particles can be obtained, for example, by treating hydrophilic particles with a silane coupling agent (e.g., methyltrimethoxy silane, methyltriethoxy silane, and octyltrimethoxy silane). Moreover, inorganic particles or silicone-oil-treated oxide particles obtained by treating inorganic particles with silicone oil optionally with heating are also suitable.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, methacryl-modified silicone oil, and α-methylstyrene-modified silicone oil.

An average primary particle diameter of the inorganic particles is not particularly limited and may be appropriately selected depending on the intended purpose, but is preferably 100 nm or less, more preferably 3 nm or more but 70 nm or less. When the average primary particle diameter is smaller than 3 nm, the inorganic particles are embedded in the toner particles, and it is difficult for the inorganic particles to effectively function. The inorganic particles having an average primary particle diameter greater than 100 nm are not preferable because these inorganic particles unevenly damage the surface of a photoconductor.

An average primary particle diameter of the hydrophobized inorganic particles is preferably from 1 nm through 100 nm, more preferably from 5 nm through 70 nm. The external additive preferably includes at least one kind of inorganic particles having an average primary particle diameter of 20 nm or less, and at least one kind of inorganic particles having an average primary particle diameter of 30 nm or more. The external additive preferably has a specific surface area of from 20 $m^2/g$ through 500 $m^2/g$ as measured by a BET method.

An amount of the external additive is not particularly limited and may be appropriately selected depending on the intended purpose, but is preferably from 0.1 parts by mass through 5 parts by mass, more preferably from 0.3 parts by mass through 3 parts by mass, relative to 100 parts by mass of the toner.

—Flowability Improving Agent—

The flowability improving agent is not particularly limited and may be appropriately selected depending on the intended purpose, so long as a flowing property and a charging property of the toner can be prevented from deteriorating even under high humidity through surface treatment with the flowability improving agent to increase hydrophobicity. Examples of the flowability improving agent include silane-coupling agents, silylation agents, silane-coupling agents including a fluoroalkyl group, organic titanate coupling agents, aluminium coupling agents, silicone oil, and modified silicone oil. Silica or titanium oxide is particularly preferably surface-treated with the flowability improving agent to be used as hydrophobic silica or hydrophobic titanium oxide.

—Cleanability Improving Agent—

The cleanability improving agent is added to the toner for the purpose of removing a developer remaining on a photoconductor or a primary transfer member after transfer. The cleanability improving agent is not particularly limited and may be appropriately selected depending on the intended purpose. Examples of the cleanability improving agent include fatty acid metal salts such as zinc stearate, calcium stearate, and stearic acid; and polymer particles produced through soap-free emulsion polymerization, such as polymethyl methacrylate particles and polystyrene particles. The polymer particles preferably have a relatively narrow particle size distribution, and the polymer particles suitably have a volume average particle diameter of from 0.01 μm through 1 μm.

—Magnetic Material—

The magnetic material is not particularly limited and may be appropriately selected depending on the intended purpose. Examples of the magnetic material include iron powder, magnetite, and ferrite. Among them, the magnetic material is preferably white in terms of a color tone.

<Glass Transition Temperature (Tg1st)>

A glass transition temperature (Tg1st) of the toner of the present invention at the first heating in differential scanning calorimetry (DSC) is from 20° C. through 50° C., more preferably from 25° C. through 50° C.

If the glass transition temperature (Tg) of a toner known in the art is lowered to be about 50° C. or lower, the toner tends to aggregate to each other due to a change in temperature during transportation or storage of the toner under conditions assuming summer or a tropical region. As a result, the toner is solidified in a toner bottle and adhered inside a developing device. Moreover, supply failures due to clogging of the toner in the toner bottle and formation of defected images due to toner adherence within the developing device are likely to occur.

The toner of the present invention can maintain the heat-resistant storage stability even though the toner of the present invention has a lower Tg than toners known in the art because the polyester resin A, which is a low Tg component in the toner, is non-linear. Especially in the case where the polyester resin A has a urethane or urea bond having high cohesive force, the toner of the present invention more significantly exhibits an effect of maintaining the heat-resistant storage stability.

A glass transition temperature (Tg2nd) of the toner of the present invention at the second heating in differential scanning calorimetry (DSC) is not particularly limited and may be appropriately selected according to the intended purpose, but is preferably from 0° C. through 30° C., more preferably from 10° C. through 30° C.

A difference (Tg1st−Tg2nd) between the Tg1st and the Tg2nd of the toner of the present invention is not particularly limited and may be appropriately selected according to the intended purpose, but is preferably greater than 0° C. (i.e., Tg1st>Tg2nd), more preferably 10° C. or more. The upper limit of the difference is not particularly limited and may be appropriately selected according to the intended purpose, but is preferably 50° C. or less.

When the toner of the present invention includes a crystalline polyester resin, the crystalline polyester resin is in a non-compatible state with the polyester resins A and B before heating (before the first heating), but is compatibilized with the polyester resins A and B after heating (after the first heating).

When the Tg1st is lower than 20° C., the resultant toner is deteriorated in heat-resistant storage stability and causes blocking in developing devices and filming onto a photoconductor. When the Tg1st is higher than 50° C., the resultant toner is deteriorated in low-temperature fixing ability.

When the Tg2nd is lower than 0° C., the resultant fixed image (printed matter) may be deteriorated in blocking resistance. When the Tg2nd is higher than 30° C., low-temperature fixing ability and glossiness may be unsatisfactory.

<Storage Modulus at 60° C. During Cooling>

A storage modulus of the toner of the present invention at 60° C. during cooling is $8.0\times10^6$ Pa or more, more preferably $10\times10^6$ Pa or more. When the storage modulus at 60° C. during cooling is less than $8.0\times10^6$ Pa, the resultant fixed image cannot be rapidly solidified to cause blocking in a developing device. In addition, an image intensity is decreased to potentially deteriorate the fixed images in abrasion resistance (scratch or abrasion).

<Volume Average Particle Diameter>

A volume average particle diameter of the toner is not particularly limited and may be appropriately selected depending on the intended purpose, but is preferably from 3 μm through 7 μm. A ratio of the volume average particle diameter to a number average particle diameter is preferably 1.2 or less. The toner preferably includes a component having a volume average particle diameter of 2 μm or less in an amount of 1% by number or more but 10% by number or less.

<Methods for Calculating and Analyzing Various Properties of Toner and Toner Component>

The polyester resins A and B, the crystalline polyester resin, and the release agent themselves may be measured for the Tg, the acid value, the hydroxyl value, the molecular weight, and the melting point. Alternatively, each of the toner components separated from an actual toner by, for example, gel permeation chromatography (GPC) may be subjected to analysis methods described below to calculate the Tg, the acid value, the hydroxyl value, the molecular weight, and the melting point.

For example, the toner components can be separated by GPC in the following manner.

An eluate obtained in GPC measurement using tetrahydrofuran (THF) as a mobile phase is fractionated by means of a fraction collector. Among fractions corresponding to a total area of an elution curve, fractions corresponding to a desired molecular weight are combined. The thus-combined eluates are concentrated and dried with, for example, an evaporator. Then, the resultant solid content is dissolved in a deuterated solvent (e.g., deuterated chloroform and deuterated THF) and subjected to $^1$H-NMR measurement. From an integral ratio of each element, ratios of constituent monomers of the resin included in eluted components are calculated.

Alternatively, the eluate is concentrated and then subjected to hydrolysis with, for example, sodium hydroxide. The resultant hydrolyzed product is subjected to qualitative and quantitative analysis by, for example, high performance liquid chromatography (HPLC) to calculate the ratios of constituent monomers.

Note that, in the case where the method for producing a toner forms toner base particles while producing the polyester resin through at least one of an elongation reaction and a cross-linking reaction between the non-linear reactive precursor and the curing agent, the polyester resin may be separated from an actual toner by, for example, GPC to be measured for the Tg. Alternatively, the polyester resin may be separately synthesized through at least one of the elongation reaction and the cross-linking reaction between the non-linear reactive precursor and the curing agent, and the thus-synthesized polyester resin may be measured for the Tg.

<<Means for Separating Toner Components>>

One exemplary means for separating toner components upon analysis of the toner will now be described.

First, 1 g of a toner is added to 100 mL of THF and stirred at 25° C. for 30 min to obtain a solution in which THF soluble matter is dissolved.

The solution is then filtrated through a 0.2 μm membrane filter to obtain the THF soluble matter in the toner.

Next, the THF soluble matter is dissolved in THF, and the solution is used as a sample for GPC measurement. The sample is injected to GPC used for molecular weight measurement of each resin described above.

Meanwhile, a fraction collector is disposed at an eluate outlet of GPC to fractionate an eluate every predetermined counts. Eluates are obtained every 5% in terms of an area ratio from elution onset on the elution curve (rise of the curve).

Then, for each eluted fraction, 30 mg of a sample is dissolved in 1 mL of deuterated chloroform. As a standard material, 0.05% by volume of tetramethyl silane (TMS) is added.

A glass tube for NMR measurement (diameter: 5 mm) is filled with the resultant solution, and a spectrum is obtained by means of a nuclear magnetic resonance apparatus (JNM-AL 400, available from JEOL Ltd.) by integrating 128 times at from 23° C. through 25° C.

Monomer compositions and monomer ratios of the polyester resins A and B and the crystalline polyester resin included in the toner can be determined from a peak integral ratio of the obtained spectrum.

<<Methods for Measuring Melting Point (Tm) and Glass Transition Temperature (Tg)>>

In the present invention, the melting point and the Tg can be measured, for example, by means of a differential scanning calorimeter (DSC) system ("Q-200", available from TA Instruments Japan Inc.).

Specifically, the melting point and the glass transition temperature of a sample of interest can be measured in the following manner.

Firstly, an aluminium sample container charged with about 5.0 mg of the sample of interest is placed on a holder unit, and the holder unit is then set in an electric furnace. Next, the sample is heated from −80° C. to 150° C. at a heating rate of 10° C./min under a nitrogen atmosphere (first heating). Then, the sample is cooled from 150° C. to −80° C. at a cooling rate of 10° C./min and then heated again to 150° C. at a heating rate of 10° C./min (second heating). DSC curves are generated for the first heating and the second heating by means of a differential scanning calorimeter ("Q-200", available from TA Instruments Japan Inc.).

A DSC curve for the first heating is selected from the resultant DSC curves by means of an analysis program stored in the Q-200 system, and thus the glass transition temperature at the first heating of the sample of interest can be determined. Similarly, a DSC curve for the second heating is selected, and thus the glass transition temperature at the second heating of the sample of interest can be determined.

A DSC curve for the first heating is selected from the resultant DSC curves by means of the analysis program stored in the Q-200 system, and an endothermic peak top temperature at the first heating of the sample of interest can be determined as the melting point. Similarly, the DSC curve for the second heating is selected, and an endothermic peak top temperature at the second heating of the sample of interest can be determined as the melting point.

Note that, in the present invention, for the melting point and the Tg of each of the polyester resins A and B, the crystalline polyester resin, and other components (e.g., the release agent), the endothermic peak top temperature and the Tg at the second heating are determined as the melting point and the Tg of the sample, unless otherwise stated.

<<Method for Measuring Storage Modulus During Cooling>>

In the present invention, the storage modulus during cooling can be measured using, for example, a rheometer (ARES, available from TA Instruments, Inc.).

Specifically, the storage modulus during cooling can be measured as follows.

Firstly, 0.2 g of a toner is formed into a pellet having a diameter of 10 mm by a press molding device under the press condition of a pressure of 28 MPa for 1 min to produce a measurement sample. This measurement sample is heated to be a temperature of from 40° C. through 100° C. at a heating rate of 2° C./min with a frequency of 10 Hz and a strain of 0.1% using parallel plates having a diameter of 8 mm. Then, the sample is cooled to 40° C. at a cooling rate of 10° C./min with a strain of 1%, during which a storage modulus at 60° C. is measured.

The storage modulus of the toner can be controlled by adjusting kinds and amounts of binder resins (non-crystalline resins and crystalline resins) used for the toner. For example, when the cross-linking component is included in toner materials, the cross-linking component has high elasticity and thus the storage modulus can be controlled by adjusting compositions and charged amounts of precursors of the binder resins in the toner materials.

<Method for Producing Toner>

A method for producing the toner is not particularly limited and may be appropriately selected depending on the intended purpose.

However, the toner is preferably granulated by dispersing, in an aqueous medium, an oil phase including the polyester resins A and B, preferably including the crystalline polyester resin, and, if necessary, further including, for example, the release agent and the colorant.

The toner is further preferably granulated by dispersing, in an aqueous medium, an oil phase including a polyester resin including at least one of a urethane bond and a urea bond (i.e., a prepolymer) serving as the polyester resin A and a polyester resin not including at least one of a urethane bond and a urea bond serving as the polyester resin B, the oil phase preferably including the crystalline polyester resin, and, if necessary, further including, for example, the curing agent, the release agent, and the colorant.

Examples of the method for producing the toner include a dissolution suspension method known in the art.

As one example of the dissolution suspension method, a method in which toner base particles are formed while producing the polyester resin through at least one of the elongation reaction and the cross-linking reaction between the prepolymer and the curing agent will now be described.

In this method, preparation of an aqueous medium, preparation of an oil phase including toner materials, emulsification or dispersion of the toner materials, and removal of an organic solvent are performed.

—Preparation of Aqueous Medium (Aqueous Phase)—

The preparation of the aqueous phase can be performed, for example, by dispersing resin particles in the aqueous medium. An amount of the resin particles to be added to the aqueous medium is not particularly limited and may be appropriately selected depending on the intended purpose, but is preferably from 0.5 parts by mass through 10 parts by mass relative to 100 parts by mass of the aqueous medium.

The aqueous medium is not particularly limited and may be appropriately selected depending on the intended purpose. Examples of the aqueous medium include water, solvents miscible with water, and mixtures of water and solvents miscible with water. These may be used alone or in combination. Among them, water is preferable.

The solvent miscible with water is not particularly limited and may be appropriately selected depending on the intended purpose. Examples of the solvent miscible with water include alcohols, dimethyl formamide, tetrahydrofuran, cellosolves, and lower ketones. Examples of the alcohols include methanol, isopropanol, and ethylene glycol. Examples of the lower ketones include acetone and methyl ethyl ketone.

—Preparation of Oil Phase—

The oil phase including the toner materials can be prepared by dissolving or dispersing, in an organic solvent, toner materials including at least a polyester resin including at least one of a urethane bond and a urea bond (i.e., a prepolymer), a polyester resin not including at least one of a urethane bond and a urea bond, and the crystalline polyester resin, and if necessary, further including, for example, the curing agent, the release agent, and the colorant.

The organic solvent is not particularly limited and may be appropriately selected depending on the intended purpose, but is preferably an organic solvent having a boiling point of lower than 150° C. from the viewpoint of easiness of removal.

Examples of the organic solvent having a boiling point of lower than 150° C. include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone.

These may be used alone or in combination.

Among them, ethyl acetate, toluene, xylene, benzene, methylene chloride, 1,2-dichloroethane, chloroform, and carbon tetrachloride are preferable, and ethyl acetate is more preferable.

—Emulsification or Dispersion—

The emulsification or dispersion of the toner materials can be performed by dispersing the oil phase including the toner materials in the aqueous medium. Upon the emulsification or dispersion of the toner materials, the curing agent and the prepolymer are allowed to undergo at least one of the elongation reaction and the cross-linking reaction.

Reaction conditions (e.g., reaction time and reaction temperature) for producing the prepolymer are not particularly limited and may be appropriately selected depending on combinations of the curing agent and the prepolymer. The reaction time is preferably from 10 min through 40 hours, more preferably from 2 hours through 24 hours. The reaction temperature is preferably from 0° C. through 150° C., more preferably from 40° C. through 98° C.

A method for stably forming a dispersion liquid including the prepolymer in the aqueous medium is not particularly limited and may be appropriately selected depending on the intended purpose. One exemplary method thereof includes: adding an oil phase, which has been prepared by dissolving or dispersing toner materials in a solvent, to a phase of the aqueous medium; and dispersing the resultant with shear force. A disperser used for the dispersing is not particularly limited and may be appropriately selected depending on the intended purpose. Examples of the disperser include a low-speed shearing disperser, a high-speed shearing disperser, a friction disperser, a high-pressure jetting disperser, and an ultrasonic disperser.

Among them, a high-speed shearing disperser is preferable, because a particle diameter of dispersoid (oil droplets) can be adjusted to be from 2 μm through 20 μm.

When the high-speed shearing disperser is used, conditions (e.g., number of revolutions, dispersing time, and dispersing temperature) may be appropriately selected depending on the intended purpose.

The number of revolutions is preferably from 1,000 rpm through 30,000 rpm, more preferably from 5,000 rpm through 20,000 rpm. The dispersing time is preferably from 0.1 min through 5 min in a batch manner. The dispersing temperature is preferably from 0° C. through 150° C., more preferably from 40° C. through 98° C. under pressure. Note that, generally speaking, the dispersing can be easily performed at a higher dispersing temperature.

An amount of the aqueous medium used for the emulsification or dispersion of the toner materials is not particularly limited and may be appropriately selected depending on the intended purpose, but is preferably from 50 parts by mass through 2,000 parts by mass, more preferably from 100 parts by mass through 1,000 parts by mass, relative to 100 parts by mass of the toner materials. When the amount of the aqueous medium is less than 50 parts by mass, the dispersion state of the toner materials is deteriorated, and toner base particles having a predetermined particle diameter may not be obtained. When the amount of the aqueous medium is more than 2,000 parts by mass, the production cost may increase.

When the oil phase including the toner materials is emulsified or dispersed, a dispersing agent is preferably used for the purpose of stabilizing dispersoid (e.g., oil droplets) to form toner particles into a desired shape and to give a sharp particle size distribution to the toner particles.

The dispersing agent is not particularly limited and may be appropriately selected depending on the intended purpose. Examples of the dispersing agent include surfactants, water-insoluble inorganic-compound dispersing agents, and polymer protective colloids. These may be used alone or in combination. Among them, surfactants are preferable.

The surfactants are not particularly limited and may be appropriately selected depending on the intended purpose. Examples of the surfactants include anionic surfactants, cationic surfactants, nonionic surfactants, and amphoteric surfactants. Examples of the anionic surfactants include alkyl benzene sulfonates, α-olefin sulfonates, and phosphoric acid esters. Among them, those including a fluoroalkyl group are preferable.

—Removal of Organic Solvent—

A method for removing the organic solvent from the dispersion liquid (e.g., emulsified slurry) is not particularly limited and may be appropriately selected depending on the intended purpose. Examples of the method include a method in which an entire reaction system is gradually heated to evaporate the organic solvent in the oil droplets and a method in which the dispersion liquid is sprayed in a dry atmosphere to remove the organic solvent in the oil droplets.

Once the organic solvent has been removed, toner base particles are formed. The toner base particles can be subjected to, for example, washing and drying, and can be further subjected to, for example, classification. The classification may be performed by removing fine particles with a cyclone, a decanter, or a centrifuge in a liquid, or may be performed after drying.

The resultant toner base particles may be mixed with particles such as the external additive and the charge control agent. Application of a mechanical impact during the mixing can prevent particles such as the external additive from exfoliating from surfaces of the toner base particles.

A method for applying the mechanical impact is not particularly limited and may be appropriately selected depending on the intended purpose. Examples of the method include a method in which an impact is applied to a mixture by a blade rotating at a high speed and a method in which a mixture is charged into a high-speed gas stream and accelerated to make the particles crash to each other or to an appropriate impact plate.

A device used for the above-described method is not particularly limited and may be appropriately selected depending on the intended purpose. Examples of the device include ANGMILL (available from Hosokawa Micron Corporation), I-type mill (available from Nippon Pneumatic Mfg. Co., Ltd.) modified to reduce a pulverizing air pressure, a hybridization system (available from Nara Machinery Co., Ltd.), a kryptron system (available from Kawasaki Heavy Industries, Ltd.), and an automatic mortar.

(Developer)

A developer of the present invention includes at least the toner of the present invention; and, if necessary, further includes appropriately selected other components (e.g., a carrier). Accordingly, the developer is excellent in a transfer property and a charging ability and can stably form high quality images. Note that, the developer may be a one-component developer or a two-component developer, but is preferably the two-component developer from the viewpoint of prolonged service life when used in a high-speed printer responding to the recent improvement in information processing speed.

When the developer is used as the one-component developer, diameters of the toner particles are changed to only a small extent even after the toner is supplied and consumed repeatedly. In addition, the toner is less likely to cause filming onto a developing roller or fuse to a member such as a blade for thinning a layer thickness of the toner. Moreover, excellent and stable developing ability and images can be achieved even when the developer is stirred in a developing device over a long period of time.

When the developer is used as the two-component developer, diameters of the toner particles are changed to only a small extent even after the toner is supplied and consumed repeatedly over a long period of time. In addition, excellent and stable developing ability and images can be achieved even when the developer is stirred in a developing device over a long period of time.

<Carrier>

The carrier is not particularly limited and may be appropriately selected depending on the intended purpose, but is preferably a carrier including a core and a resin layer covering the core.

—Core—

A material of the core is not particularly limited and may be appropriately selected depending on the intended purpose. Examples of the material include manganese-strontium materials (from 50 emu/g through 90 emu/g) and manganese-magnesium materials (from 50 emu/g through 90 emu/g). In order to ensure a sufficient image density, high magnetic materials such as iron powder (100 emu/g or higher) and magnetite (from 75 emu/g through 120 emu/g) are preferably used. Meanwhile, low magnetic materials such as copper-zinc materials (from 30 emu/g through 80 emu/g) are preferably used because it is possible to reduce an impact applied to a photoconductor by the developer in the form of a brush, which is advantageous for improving image quality.

These may be used alone or in combination.

A volume average particle diameter of the core is not particularly limited and may be appropriately selected depending on the intended purpose, but is preferably from 10 μm through 150 μm, more preferably from 40 μm through 100 μm. When the volume average particle diameter is less than 10 μm, the amount of fine carrier particles is increased to decrease magnetization per particle, potentially leading to carrier scattering. When the volume average particle diameter is more than 150 μm, the carrier particles are decreased in specific surface area, potentially leading to toner scattering. Especially, in the case of full-color printing of images including many solid image portions, reproducibility in the solid image portions is deteriorated.

The toner of the present invention may be mixed with the carrier for using as the two-component developer.

An amount of the carrier included in the two-component developer is not particularly limited and may be appropriately selected depending on the intended purpose, but is preferably from 90 parts by mass through 98 parts by mass, more preferably from 93 parts by mass through 97 parts by mass, relative to 100 parts by mass of the two-component developer.

The developer of the present invention may be suitably used in image formation by various known electrophotographies such as magnetic one-component developing methods, non-magnetic one-component developing methods, and two-component developing methods.

(Developer Stored Container)

A developer stored container configured to contain the developer of the present invention is not particularly limited and may be appropriately selected from containers known in the art. Examples of the container include containers including a container main body and a cap.

A size, a shape, a structure, and a material of the container main body are not particularly limited. The container main body is preferably, for example, cylindrical. Preferably, the container has spirally-arranged concavo-convex portions on an inner circumferential surface, the developer included in the container can be transferred to an outlet port by rotating the container, and some or all of the spirally-arranged concavo-convex portions are folded like bellows. The materials of the container preferably have excellent dimensional accuracy. Examples of the materials include polyester resins, polyethylene resins, polypropylene resins, polystyrene resins, polyvinyl chloride resins, polyacrylic acids, polycarbonate resins, ABS resins, and polyacetal resins.

The developer stored container can be easily stored or transported and has excellent handleability. Therefore, the developer stored container can be detachably mounted to, for example, process cartridges or image forming apparatuses described below to replenish the developer.

(Image Forming Apparatus and Image Forming Method)

An image forming apparatus of the present invention includes at least an electrostatic latent image bearer, an electrostatic-latent-image-forming means, and a developing means; and, if necessary, further includes other means.

An image forming method using the toner of the present invention includes at least an electrostatic-latent-image-forming step and a developing step; and, if necessary, further includes other steps.

The image forming method can suitably be performed by the image forming apparatus. The electrostatic-latent-image-forming step can suitably be performed by the electrostatic-latent-image-forming means. The developing step can suitably be performed by the developing means. The other steps can suitably be performed by the other means.

<Electrostatic Latent Image Bearer>

A material, a structure, and a size of the electrostatic latent image bearer are not particularly limited and may be appropriately selected from those known in the art. Examples of the material of the electrostatic latent image bearer include inorganic photoconductors (e.g., amorphous silicon and selenium) and organic photoconductors (e.g., polysilane and phthalopolymethine). Among them, amorphous silicon is preferable from the viewpoint of long service life. The amorphous silicon photoconductor may be a photoconductor which is produced by heating a support to be a temperature of from 50° C. through 400° C. and then forming a photoconductive layer of a-Si on the support through film formation methods (e.g., vacuum vapor deposition, sputtering, ion plating, thermal CVD (Chemical Vapor Deposition), photo-CVD, and plasma CVD). Among them, suitable is the plasma CVD; i.e., a method in which gaseous raw materials are decomposed through application of direct current or high frequency or through microwave glow discharge, to form an a-Si deposited film on the support.

The electrostatic latent image bearer is preferably cylindrical. An outer diameter of the cylindrical electrostatic latent image bearer is preferably from 3 mm through 100 mm, more preferably from 5 mm through 50 mm, particularly preferably from 10 mm through 30 mm.

<Electrostatic Latent Image Forming Means and Electrostatic Latent Image Forming Step>

The electrostatic-latent-image-forming means is not particularly limited and may be appropriately selected depending on the intended purpose, so long as the electrostatic-latent-image-forming means is configured to form an electrostatic latent image on the electrostatic latent image bearer. Examples of the electrostatic-latent-image-forming means include a means including at least: a charging member configured to charge a surface of the electrostatic latent image bearer; and an exposure member configured to imagewise expose the surface of the electrostatic latent image bearer to light.

The electrostatic-latent-image-forming step is not particularly limited and may be appropriately selected depending on the intended purpose, so long as the electrostatic-latent-image-forming step is a step of forming an electrostatic latent image on the electrostatic latent image bearer. The electrostatic-latent-image-forming step can be performed using the electrostatic-latent-image-forming means by, for example, charging a surface of the electrostatic latent image bearer and then imagewise exposing the surface to light.

—Charging Member and Charging—

The charging member is not particularly limited and may be appropriately selected depending on the intended purpose. Examples of the charging member include contact chargers known per se including a conductive or semiconductive roller, brush, film and rubber blade; and non-contact chargers utilizing corona discharge such as corotron and scorotron.

The charging can be performed by, for example, applying voltage to a surface of the electrostatic latent image bearer using the charging member.

The charging member may have any shape such as a magnetic brush or a fur brush as well as a roller. The shape of the charging member may be selected according to the specification or configuration of the image forming apparatus.

The charging member is not limited to the contact charging members as described above. However, the contact charging members are preferably used because it is possible to produce an image forming apparatus in which a lower amount of ozone is generated from the charging member.

—Exposure Member and Exposure—

The exposure member is not particularly limited and may be appropriately selected depending on the intended purpose, so long as the exposure member can imagewise expose a surface of the electrostatic latent image bearer, which has been charged with the charging member, to light according to an image to be formed. Examples of the exposure member include various exposure members such as copy optical exposure members, rod lens array exposure members, laser optical exposure members, and liquid crystal shutter optical exposure members.

A light source used for the exposure member is not particularly limited and may be appropriately selected depending on the intended purpose. Examples of the light source include light emitters in general such as fluorescent lamps, tungsten lamps, halogen lamps, mercury lamps, sodium lamps, light-emitting diodes (LED), laser diodes (LD), and electroluminescence (EL) devices.

Also, various filters may be used for the purpose of emitting only light having a desired wavelength range. Examples of the filters include sharp-cut filters, band-pass filters, infrared cut filters, dichroic filters, interference filters, and color temperature conversion filters.

The exposure can be performed by, for example, imagewise exposing a surface of the electrostatic latent image bearer to light using the exposure member.

Note that, in the present invention, a back-exposure method may be employed. That is, the electrostatic latent image bearer may be imagewise exposed to light from a back side.

<Developing Means and Developing Step>

The developing means is not particularly limited and may be appropriately selected depending on the intended purpose, so long as the developing means includes a toner and is configured to develop the electrostatic latent image formed on the electrostatic latent image bearer to form a visible image.

The developing step is not particularly limited and may be appropriately selected depending on the intended purpose, so long as the developing step is a step of developing the electrostatic latent image formed on the electrostatic latent image bearer with a toner to form a visible image. The developing step can be performed by the developing means.

The developing means may be used in a dry-developing manner or a wet-developing manner, and may be a monochrome developing means or a multi-color developing means.

The developing means preferably includes a stirrer configured to charge the toner by friction generated during stirring; a magnetic-field generating means which is fixed inside the developing means; and a developer bearer configured to be rotatable while bearing a developer including the toner on a surface of the developer bearer.

In the developing means, for example, the toner and the carrier are stirred and mixed, and the toner is charged by friction generated during stirring and mixing. The thus-charged toner is held in the form of a brush on a surface of a rotating magnetic roller to form a magnetic brush. The magnetic roller is disposed adjacent to the electrostatic latent image bearer and thus part of the toner constituting the magnetic brush formed on the surface of the magnet roller is transferred onto a surface of the electrostatic latent image bearer by the action of electrically attractive force. As a result, the electrostatic latent image is developed with the toner to form a visual toner image on the surface of the electrostatic latent image bearer.

<Other Means and Other Steps>

Examples of the other means include a transfer means, a fixing means, a cleaning means, a charge-eliminating means, a recycling means, and a control means.

Examples of the other steps include a transfer step, a fixing step, a cleaning step, a charge-eliminating step, a recycling step, and a control step.

—Transfer Means and Transfer Step—

The transfer means is not particularly limited and may be appropriately selected depending on the intended purpose, so long as the transfer means is configured to transfer the visible image onto a recording medium. Preferably, the transfer means includes a primary transfer means configured to transfer the visible image onto an intermediate transfer member to form a composite transfer image; and a secondary transfer means configured to transfer the composite transfer image onto a recording medium.

The transfer step is not particularly limited and may be appropriately selected depending on the intended purpose, so long as the transfer step is a step of transferring the visible image onto a recording medium. Preferably, the transfer step includes primarily transferring the visible image onto the intermediate transfer member and then secondarily transferring the visible image onto the recording medium.

For example, the transfer step can be performed using the transfer means by charging the photoconductor with a transfer charger to transfer the visible image.

Here, when the image to be secondarily transferred onto the recording medium is a color image made of a plurality of color toners, the transfer step may be performed as follows: the color toners are sequentially superposed on top of another on the intermediate transfer member by the transfer means to form an image on the intermediate transfer member, and then, the image on the intermediate transfer member is secondarily transferred at one time onto the recording medium by the intermediate transfer means.

The intermediate transfer member is not particularly limited and may be appropriately selected from known transfer members depending on the intended purpose. For example, the intermediate transfer member is suitably a transfer belt.

The transfer means (the primary transfer means and the secondary transfer means) preferably includes at least a transfer device configured to transfer the visible image formed on the photoconductor onto the recording medium utilizing peeling charging. Examples of the transfer device include corona transfer devices utilizing corona discharge, transfer belts, transfer rollers, pressing transfer rollers, and adhesive transfer devices.

The recording medium is not particularly limited and may be appropriately selected depending on the purpose, so long as a developed but unfixed image can be transferred onto the recording medium. Typically, plain paper is used as the recording medium, but a PET base for OHP can also be used.

—Fixing Means and Fixing Step—

The fixing means is not particularly limited and may be appropriately selected depending on the intended purpose, so long as the fixing means is configured to fix a transferred image which has been transferred on the recording medium. The fixing means is preferably a known heating-pressurizing member. Examples of the heating-pressurizing member include a combination of a heat roller and a press roller and a combination of a heat roller, a press roller, and an endless belt.

The fixing step is not particularly limited and may be appropriately selected depending on the intended purpose, so long as the fixing step is a step of fixing a visible image which has been transferred on the recording medium. The fixing step may be performed every time an image of each color toner is transferred onto the recording medium, or at one time (i.e., at the same time) on a superposed image of color toners.

The fixing step can be performed by the fixing means.

The heating-pressurizing member usually performs heating preferably at from 80° C. through 200° C.

Note that, in the present invention, known photofixing devices may be used instead of or in addition to the fixing means depending on the intended purpose.

A surface pressure at the fixing step is not particularly limited and may be appropriately selected depending on the intended purpose, but is preferably from 10 $N/cm^2$ through 80 $N/cm^2$.

—Cleaning Means and Cleaning Step—

The cleaning means is not particularly limited and may be appropriately selected depending on the intended purpose, so long as the cleaning means is configured to be able to remove the toner remaining on the photoconductor. Examples of the cleaning means include magnetic brush cleaners, electrostatic brush cleaners, magnetic roller cleaners, blade cleaners, brush cleaners, and web cleaners.

The cleaning step is not particularly limited and may be appropriately selected depending on the intended purpose, so long as the cleaning step is a step of being able to remove the toner remaining on the photoconductor. The cleaning step may be performed by the cleaning means.

—Charge-Eliminating Means and Charge-Eliminating Step—

The charge-eliminating means is not particularly limited and may be appropriately selected depending on the intended purpose, so long as the charge-eliminating means is configured to apply a charge-eliminating bias to the photoconductor to charge-eliminate the photoconductor. Examples of the charge-eliminating means include charge-eliminating lamps.

The charge-eliminating step is not particularly limited and may be appropriately selected depending on the intended purpose, so long as the charge-eliminating step is a step of applying a charge-eliminating bias to the photoconductor for charge elimination. The charge-eliminating step may be performed by the charge-eliminating means.

—Recycling Means and Recycling Step—

The recycling means is not particularly limited and may be appropriately selected depending on the intended purpose, so long as the recycling means is configured to recycle the toner, which has been removed in the cleaning step, to the developing device. Examples of the recycling means include known conveying means.

The recycling step is not particularly limited and may be appropriately selected depending on the intended purpose, so long as the recycling step is a step of recycling the toner, which has been removed in the cleaning step, to the developing device. The recycling step can be performed by the recycling means.

—Control Means and Control Step—

The control means is not particularly limited and may be appropriately selected depending on the intended purpose, so long as the control means is configured to be able to control operation of each of the above means. Examples of the control means include devices such as sequencers and computers.

The control step is not particularly limited and may be appropriately selected depending on the intended purpose, so long as the control step is a step of being able to control operation of each of the above steps. The control step can be performed by the control means.

One exemplary aspect for forming an image by an image forming apparatus of the present invention will now be described referring to FIG. 1. A color image forming apparatus 100A illustrated in FIG. 1 includes a photoconductor drum 10 serving as the electrostatic latent image bearer (hereinafter may be referred to as a "photoconductor 10"), a charging roller 20 serving as the charging means, an exposure device 30 serving as the exposure means, a developing device 40 serving as the developing means, an intermediate transfer member 50, a cleaning device 60 including a cleaning blade and serving as the cleaning means, and a charge-eliminating lamp 70 serving as the charge-eliminating means.

The intermediate transfer member 50 is an endless belt and is designed so as to be movable in a direction indicated by the arrow by three rollers 51. The three rollers 51 are disposed inside the belt and the belt is stretched around the three rollers 51. Some of the three rollers 51 also function as a transfer bias roller which may apply a predetermined transfer bias (primary transfer bias) to the intermediate transfer member 50. A cleaning device 90 including a cleaning blade is disposed adjacent to the intermediate transfer member 50. Further, a transfer roller 80 serving as the transfer means is disposed adjacent to the intermediate transfer member 50 so as to face the intermediate transfer member 50. The transfer roller 80 can apply a transfer bias for transferring (secondarily transferring) a developed image (toner image) onto a sheet of transfer paper 95 serving as a recording medium. Around the intermediate transfer member 50, a corona charger 58, which is configured to apply charges to a toner image on the intermediate transfer member 50, is disposed between a contact portion of the photoconductor 10 with the intermediate transfer member 50 and a contact portion of the intermediate transfer member 50 with the sheet of the transfer paper 95 in a rotational direction of the intermediate transfer member 50.

The developing device 40 includes a developing belt 41 serving as the developer bearer and developing units arranged around the developing belt 41 (a black developing unit 45K, a yellow developing unit 45Y, a magenta developing unit 45M, and a cyan developing unit 45C). Note that, the black developing unit 45K includes a developer stored container 42K, a developer supply roller 43K, and a developing roller 44K. The yellow developing unit 45Y includes a developer stored container 42Y, a developer supply roller 43Y, and a developing roller 44Y. The magenta developing unit 45M includes a developer stored container 42M, a developer supply roller 43M, and a developing roller 44M. The cyan developing unit 45C includes a developer stored container 42C, a developer supply roller 43C, and a developing roller 44C. Also, the developing belt 41 is an endless belt which is rotatably stretched around a plurality of belt rollers and is partially in contact with the electrostatic latent image bearer 10.

In the color image forming apparatus 100A illustrated in FIG. 1, for example, the charging roller 20 uniformly charges the photoconductor drum 10. The exposure device 30 imagewise exposes the photoconductor drum 10 to light to form an electrostatic latent image. The electrostatic latent image formed on the photoconductor drum 10 is developed with a toner supplied from the developing device 40 to form a toner image. The toner image is transferred (primarily transferred) onto the intermediate transfer member 50 by voltage applied from the roller 51 and then transferred (secondarily transferred) onto the sheet of the transfer paper 95. As a result, a transferred image is formed on the sheet of the transfer paper 95. Note that, a residual toner remaining on the photoconductor 10 is removed by the cleaning device 60, and the photoconductor 10 is once charge-eliminated by the charge-eliminating lamp 70.

Figure 2:
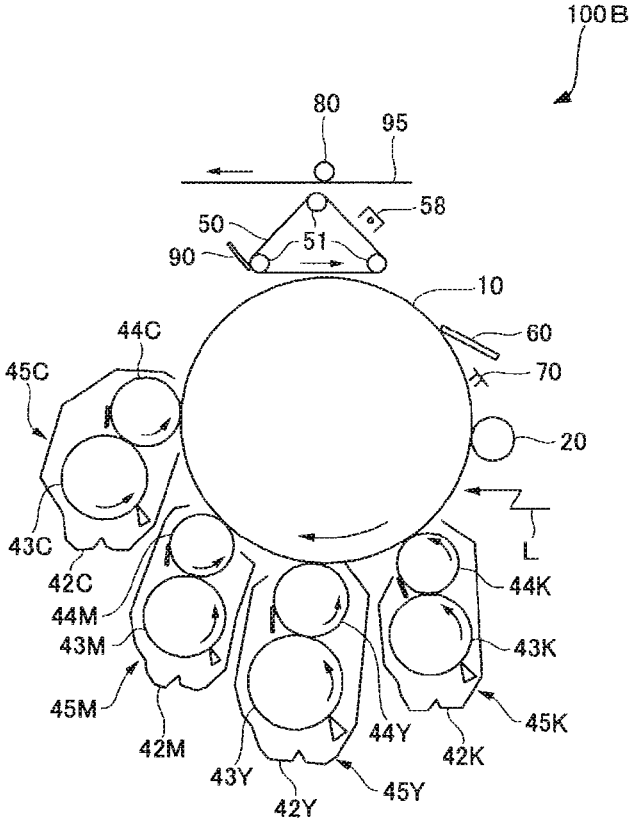
FIG. 2 is a schematic, configurational view illustrating another exemplary image forming apparatus according to the present invention.

FIG. 2 illustrates another exemplary image forming apparatus of the present invention. An image forming apparatus 100B has the same configuration as the image forming apparatus 100A illustrated in FIG. 1 except that the developing belt 41 is not included and the black developing unit 45K, the yellow developing unit 45Y, the magenta developing unit 45M, and the cyan developing unit 45C are disposed around the photoconductor drum 10 so as to directly face the photoconductor drum 10.

Figure 3:
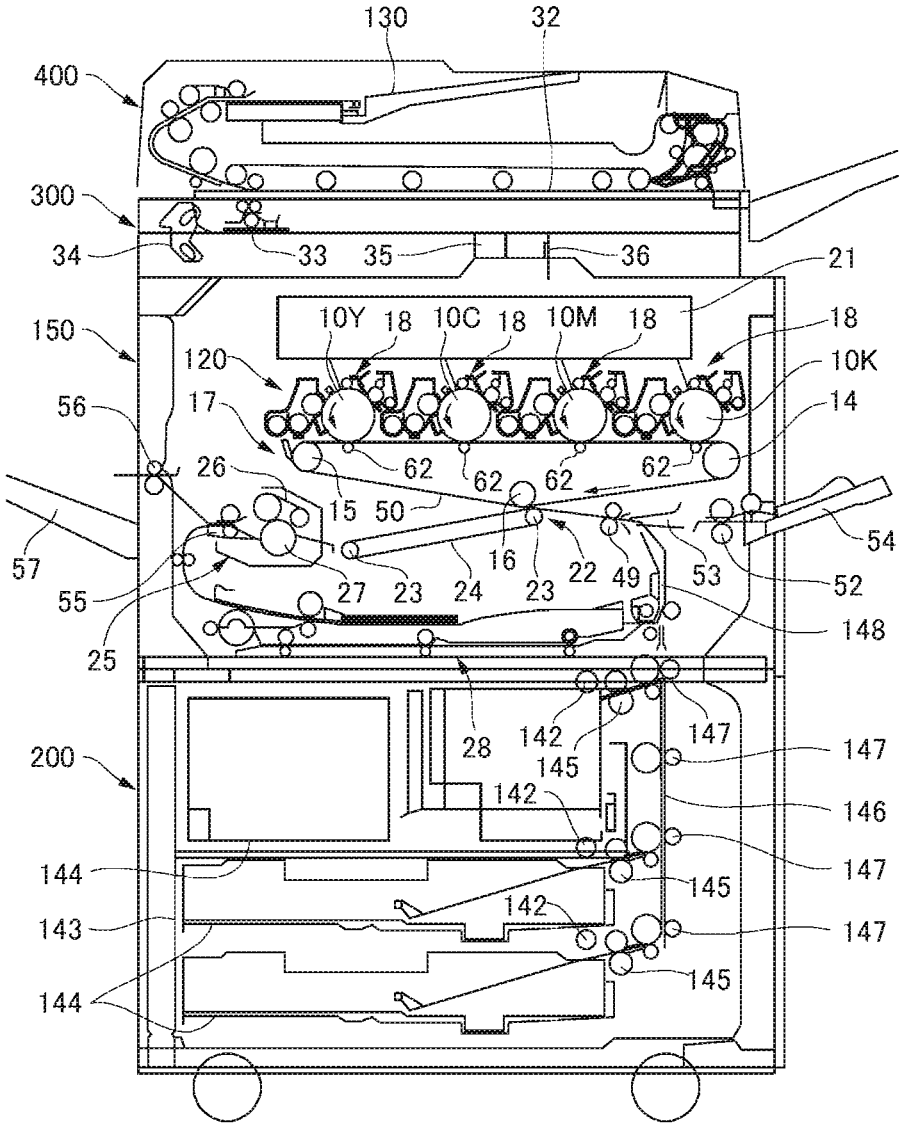
FIG. 3 is a schematic, configurational view illustrating another exemplary image forming apparatus according to the present invention.

FIG. 3 illustrates another exemplary image forming apparatus of the present invention. The image forming apparatus 100C includes a copier main body 150, a paper feeding table 200, a scanner 300, and an automatic document feeder (ADF) 400.

An endless-belt-type intermediate transfer member 50 is disposed at a central part of the copier main body 150. The intermediate transfer member 50 is stretched around support rollers 14, 15 and 16 and is configured to be rotatable in the clockwise direction in FIG. 3. A cleaning device for an intermediate transfer member 17 is disposed adjacent to the support roller 15, and is configured to remove a residual toner remaining on the intermediate transfer member 50. A tandem developing device 120, in which four image forming means 18 of yellow, cyan, magenta, and black are arranged in parallel along a conveying direction of the intermediate transfer member 50 so as to face the intermediate transfer member 50, is disposed on the intermediate transfer member 50 which is stretched around the support rollers 14 and 15. An exposure device 21 serving as the exposure member is disposed adjacent to the tandem developing device 120. A secondary transfer device 22 is disposed on a side of the intermediate transfer member 50 opposite to the side on which the tandem developing device 120 is disposed. The secondary transfer device 22 includes a secondary transfer belt 24 which is an endless belt, and the secondary transfer belt 24 is stretched around a pair of rollers 23. In this configuration, a sheet of transfer paper conveyed on the secondary transfer belt 24 and the intermediate transfer member 50 can contact with each other. A fixing device 25 serving as the fixing means is disposed adjacent to the secondary transfer device 22. The fixing device 25 includes a fixing belt 26 which is an endless belt and a press roller 27 which is disposed so as to be pressed against the fixing belt.

Note that, in the tandem image forming apparatus, a sheet inverting device 28 is disposed adjacent to the secondary transfer device 22 and the fixing device 25. The sheet inverting device 28 is configured to invert the sheet of the transfer paper in the case of forming images on both sides of the sheet of the transfer paper.

Next, a method for forming a full-color image (color-copying) using the tandem developing device 120 will now be described. Firstly, a document is set on a document table 130 of the automatic document feeder (ADF) 400. Alternatively, the automatic document feeder 400 is opened, the document is set on a contact glass 32 of the scanner 300, and the automatic document feeder 400 is closed.

When a start button (not illustrated) is pressed, the document is conveyed onto the contact glass 32 and then the scanner 300 operates in the case where the document has been set on the automatic document feeder 400; or the scanner 300 operates immediately in the case where the document has been set on the contact glass 32. Then, a first travelling body 33 and a second travelling body 34 travel. At this time, the document is irradiated with light from a light source in the first travelling body 33. The light reflected from a surface of the document is reflected by a mirror in the second travelling body 34 and then is received by a reading sensor 36 through an imaging forming lens 35. Thus, the color document (color image) is read to obtain image information of black, yellow, magenta, and cyan.

Figure 4:
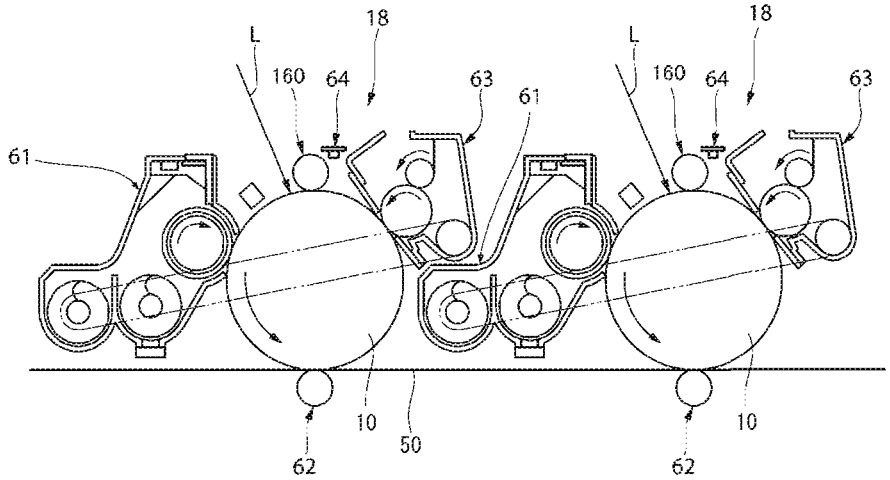
FIG. 4 is a partially enlarged view of FIG. 3.

The image information of black, yellow, magenta, and cyan is transmitted to the image forming means 18 (black-image-forming means, yellow-image-forming means, magenta-image-forming means, and cyan-image-forming means) in the tandem developing device 120 to form toner images of black, yellow, magenta, and cyan in the image forming means. As illustrated in FIG. 4, the image forming means 18 in the tandem developing device 120 include electrostatic latent image bearers 10 (black-electrostatic-latent image bearer 10K, yellow-electrostatic-latent image bearer 10Y, magenta-electrostatic-latent image bearer 10M, and cyan-electrostatic-latent image bearer 10C); a charging device 160 serving as the charging means and configured to uniformly charge the electrostatic latent image bearers 10; an exposure device configured to imagewise expose the electrostatic latent image bearers to light (L in FIG. 4) based on image information of colors to form electrostatic latent images corresponding to color images on the electrostatic latent image bearers; a developing device 61 serving as the developing means and configured to develop the electrostatic latent images with color toners (black toner, yellow toner, magenta toner, and cyan toner) to form toner images of the color toners; a transfer charger 62 configured to transfer the toner images onto the intermediate transfer member 50; a cleaning device 63; and a charge-eliminating device 64. The image forming means 18 can form monochrome images (black image, yellow image, magenta image, and cyan image) based on the image information of colors. The thus-formed black image (i.e., a black image formed on the black-electrostatic-latent image bearer 10K), the thus-formed yellow image (i.e., a yellow image formed on the yellow-electrostatic-latent image bearer 10Y), the thus-formed magenta image (i.e., a magenta image formed on the magenta-electrostatic-latent image bearer 10M), and the thus-formed cyan image (i.e., a cyan image formed on the cyan-electrostatic-latent image bearer 10C) are sequentially transferred (primarily transferred) onto the intermediate transfer member 50 which is rotatably moved by the support rollers 14, 15 and 16. The black image, the yellow image, the magenta image, and the cyan image are superposed on the intermediate transfer member 50 to form a composite color image (color transferred image).

Meanwhile, in the paper feeding table 200, one of paper feeding rollers 142 is selectively rotated to feed a sheet (recording paper) from one of paper feeding cassettes 144 which are placed in multiple stages in a paper bank 143. The sheet is separated one by one by a separation roller 145 and sent to a paper feeding path 146. Then, the sheet is conveyed by a conveying roller 147, is guided to a paper feeding path 148 in the copier main body 150, and is stopped by a registration roller 49. Alternatively, a paper feeding roller 142 is rotated to feed a sheet (recording paper) on a manual paper feeding tray 54. The sheet is separated one by one by a separation roller 52, is guided to a manual paper feeding path 53, and is stopped by the registration roller 49. Note that, the registration roller 49 is generally grounded in use, but the registration roller 49 may also be used in a state where a bias is being applied to the registration roller 49 for the purpose of removing paper dust from the sheet. Then, the registration roller 49 is rotated in synchronization with the composite color image (color transferred image) formed on the intermediate transfer member 50 and the sheet (recording paper) is fed to between the intermediate transfer member 50 and the secondary transfer device 22. Thus, the composite color image is transferred (secondarily transferred) onto the sheet (recording paper) by the secondary transfer device 22 to form a color image on the sheet (recording paper). Note that, a residual toner remaining on the intermediate transfer member 50 after image transfer is removed by the cleaning device for an intermediate transfer member 17.

The sheet (recording paper), on which the color image has been transferred and formed, is conveyed by the secondary transfer device 22 to the fixing device 25. The fixing device 25 fixes the composite color image (color transferred image) on the sheet (recording paper) by the action of heat and pressure. Next, the sheet (recording paper) is switched by a switching claw 55, is ejected by an ejection roller 56, and is stacked in a paper ejection tray 57. Alternatively, the sheet is switched by the switching claw 55, is inverted by the sheet inverting device 28, and then is guided to a transfer position again. An image is also recorded on a back side of the sheet, and then the sheet is ejected by the ejection roller 56 and stacked in the paper ejection tray 57.

(Process Cartridge)

A process cartridge of the present invention is molded so as to be detachably mounted to various image forming apparatuses. The process cartridge includes at least an electrostatic latent image bearer configured to bear an electrostatic latent image; and a developing means configured to develop the electrostatic latent image borne on the electrostatic latent image bearer with the developer of the present invention to form a toner image. Note that, this process cartridge may further include other means, if necessary.

The developing means includes at least: a developer stored container configured to contain the developer of the present invention; and a developer bearer configured to bear and convey the developer included in the developer stored container. Note that, the developing means may further include, for example, a regulating member configured to regulate a thickness of the developer to be borne.

Figure 5:
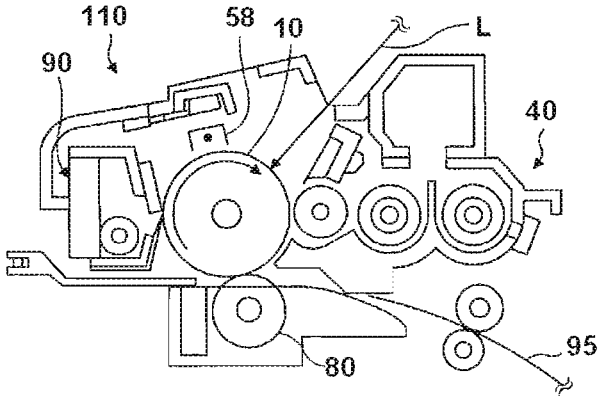
FIG. 5 is a schematic, configurational view illustrating one exemplary process cartridge.

FIG. 5 illustrates one exemplary process cartridge of the present invention. A process cartridge 110 includes a photoconductor drum 10, a corona charger 52, a developing device 40, a transfer roller 80, and a cleaning device 90.

EXAMPLES

The present invention will now be described in more detail by way of the following Examples and Comparative Examples. However, the present invention is not limited to the Examples in any way. Note that, the Examples are described according to the following notes (1) to (4):

(1) Unless otherwise expressly specified, "part(s)" means "part(s) by mass" and "%" means "% by mass";

(2) "%" described in rows of Diol and Dicarboxylic acid in Tables 1-1 to 1-4 means "mol %";

(3) Measurement values were obtained by the above-described methods; and (4) Tgs, melting points, and molecular weights of, for example, Non-crystalline polyester resin A, Non-crystalline polyester resin B, and Crystalline polyester resin C were measured from resins obtained in Production Examples.

Production Example 1

<Synthesis of Ketimine>

A reaction vessel to which a stirring bar and a thermometer had been set was charged with 170 parts of isophoronediamine and 75 parts of methyl ethyl ketone. The resultant mixture was allowed to react at 50° C. for 5 hours to obtain [Ketimine compound 1].

The [Ketimine compound 1] was found to have an amine value of 418.

Production Example A-1

<Synthesis of THF-Insoluble Non-Crystalline Polyester Resin A-1>

—Synthesis of Prepolymer A-1—

A reaction vessel equipped with a condenser, a stirrer, and a nitrogen-introducing tube was charged with 3-methyl-1,5-pentanediol, terephthalic acid, adipic acid, and trimethylolpropane so that a molar ratio of hydroxyl group to carboxyl group (OH/COOH) was 1.10. As a diol component, 100 mol % of 3-methyl-1,5-pentanediol was used, and, as a dicarboxylic acid component, 50 mol % of terephthalic acid and 50 mol % of adipic acid were used. The trimethylolpropane was added so as to be 1.5 mol % relative to all the monomers, together with titanium tetraisopropoxide (1,000 ppm relative to all the resin components). Then, the resultant mixture was heated to 200° C. for about 4 hours, heated to 230° C. for 2 hours, and allowed to react until water was not run off. Then, the resultant was further allowed to react under reduced pressure of from 10 mmHg through 15 mmHg for 5 hours to obtain Intermediate polyester A-1.

Next, a reaction vessel equipped with a condenser, a stirrer, and a nitrogen-introducing tube was charged with the Intermediate polyester A-1 and isophorone diisocyanate (IPDI) so that a molar ratio (isocyanate groups in IPDI/hydroxyl groups in Intermediate polyester) was 2.0. The resultant mixture was diluted with ethyl acetate to give a 50% ethyl acetate solution and then was allowed to react at 100° C. for 5 hours to obtain Prepolymer A-1.

—Synthesis of THF-Insoluble Non-Crystalline Polyester Resin A-1—

The resultant prepolymer A-1 was stirred in a reaction vessel equipped with a heating device, a stirrer, and a nitrogen-introducing tube. The [Ketimine compound 1] was added dropwise to the reaction vessel, so that the amine in the [Ketimine compound 1] was equimolar to the isocyanate in the Prepolymer A-1. After stirring for 10 hours at 45° C., the resultant prepolymer-elongated product was taken out. The resultant prepolymer-elongated product was dried at 50° C. under reduced pressure until an amount of residual ethyl acetate was 100 ppm or less, to obtain THF-insoluble non-crystalline polyester resin A-1.

<Synthesis of THF-Insoluble Non-Crystalline Polyester Resins A-2 to A-11>

—Synthesis of Prepolymers A-2 to A-11—

Prepolymers A-2 to A-11 were obtained in the same manner as in the Synthesis of Prepolymer A-1, except that the acid component and the alcohol component were changed to acid components and alcohol components presented in Tables 1-1 to 1-4.

—Synthesis of THF-Insoluble Non-Crystalline Polyester Resins A-2 to A-11—

THF-insoluble non-crystalline polyester resins A-2 to A-11 were obtained in the same manner as in the Synthesis of THF-insoluble non-crystalline polyester resin A-1, except that the Prepolymer A-1 was changed to each of Prepolymers A-2 to A-11.

Production Example B-1

<Synthesis of THF-Soluble Non-Crystalline Polyester Resin B-1>

A four-necked flask equipped with a nitrogen-introducing tube, a drain tube, a stirrer, and a thermocouple was charged with bisphenol A ethylene oxide 2 mol adduct, 1,2-propylene glycol, terephthalic acid, and adipic acid so that a molar ratio of hydroxyl group to carboxyl group (OH/COOH) was 1.10. A molar ratio of the bisphenol A ethylene oxide 2 mol adduct to 1,2-propylene glycol was 60/40 and a molar ratio of terephthalic acid to adipic acid was 80/20. The resultant mixture was allowed to react with titanium tetraisopropoxide (500 ppm relative to all the resin components) at 230° C. under normal pressure for 8 hours, and was allowed to further react under reduced pressure of from 10 mmHg through 15 mmHg for 4 hours. Then, trimellitic anhydride was added to the reaction vessel in an amount of 1 mol % relative to all the resin components. Then, the resultant mixture was allowed to react at 180° C. under normal pressure for 3 hours to obtain THF-soluble non-crystalline polyester resin B-1.

<Synthesis of THF-Soluble Non-Crystalline Polyester Resins B-2 to B-14>

THF-soluble non-crystalline polyester resins B-2 to B-14 were obtained in the same manner as in the Synthesis of THF-soluble non-crystalline polyester resin B-1, except that the acid component and the alcohol component were changed to acid components and alcohol components presented in Tables 1-1 to 1-4.

Production Example C-1

<Synthesis of Crystalline Polyester Resin C-1>

A 5 L four-necked flask equipped with a nitrogen-introducing tube, a drain tube, a stirrer, and a thermocouple was charged with sebacic acid and 1,6-hexanediol so that a molar ratio of hydroxyl group to carboxyl group (OH/COOH) was 0.90. The resultant mixture was allowed to react with titanium tetraisopropoxide (500 ppm relative to all the resin components) at 180° C. for 10 hours, heated to 200° C., allowed to react for 3 hours, and then allowed to further react at a pressure of 8.3 kPa for 2 hours to obtain Crystalline polyester resin C-1.

Example 1

<Synthesis of Masterbatch (MB)>

Water (1,200 parts), 500 parts of carbon black (PRINTEX 35, available from Evonik Degussa Japan Co., Ltd.) [DBP oil absorption amount=42 mL/100 mg, pH=9.5], and 500 parts of the non-crystalline polyester resin B-1 were added and mixed together by means of HENSCHEL MIXER (available from NIPPON COLE & ENGINEERING CO., LTD.). The resultant mixture was kneaded by means of a two-roll mill at 150° C. for 30 min. The resultant kneaded product was cooled by rolling and then pulverized by a pulverizer to obtain [Masterbatch 1].

<Production of WAX Dispersion Liquid>

A vessel to which a stirring bar and a thermometer had been set was charged with 300 parts of paraffin wax (HNP-9, available from Nippon Seiro Co., Ltd., hydrocarbon wax, and melting point: 75° C.) serving as a release agent 1, 150 parts of the [wax dispersing agent], and 1,800 parts of ethyl acetate. The resultant was heated to 80° C. with stirring, maintained at 80° C. for 5 hours, and cooled to 30° C. for 1 hour. The resultant was dispersed by means of a bead mill (ULTRA VISCOMILL, available from AIMEX CO., Ltd.) under the following conditions: a liquid feed rate of 1 kg/hr, a disc circumferential velocity of 6 m/s, zirconia beads having a diameter of 0.5 mm packed to 80% by volume, and 3 passes, to obtain [WAX dispersion liquid 1].

<Production of Crystalline Polyester Resin Dispersion Liquid 1>

A vessel to which a stirring bar and a thermometer had been set was charged with 308 parts of the Crystalline polyester resin C and 1,900 parts of ethyl acetate. The resultant was heated to 80° C. with stirring, maintained at 80° C. for 5 hours, and cooled to 30° C. for 1 hour. The resultant was dispersed by means of a bead mill (ULTRA VISCOMILL, available from AIMEX CO., Ltd.) under the following conditions: a liquid feed rate of 1 kg/hr, a disc circumferential velocity of 6 m/s, zirconia beads having a diameter of 0.5 mm packed to 80% by volume, and 3 passes, to obtain Crystalline-polyester-resin dispersion liquid 1.

<Preparation of Oil Phase>

A vessel was charged with 50 parts of the [WAX dispersion liquid 1], 150 parts of the [Prepolymer A-1], 50 parts of the [Crystalline polyester resin dispersion liquid 1], 700 parts of the [THF-soluble non-crystalline polyester resin B-1], 100 parts of the [Masterbatch 1], and 0.2 parts of the [Ketimine compound 1]. The resultant mixture was mixed by means of a TK Homomixer (available from PRIMIX Corporation) at 7,000 rpm for 60 min to obtain [Oil phase 1]. Note that, the above-described amounts are solid contents in the raw materials.

<Synthesis of Organic Particle Emulsion (Particle Dispersion liquid)>

A reaction vessel to which a stirring bar and a thermometer had been set was charged with 683 parts of water, 11 parts of a sodium salt of sulfuric acid ester of methacrylic acid-ethylene oxide adduct (ELEMINOL RS-30, available from Sanyo Chemical Industries, Ltd.), 138 parts of styrene, 138 parts of methacrylic acid, and 1 part of ammonium persulfate. The resultant was stirred at 400 rpm for 15 min to obtain a white emulsion. The resultant emulsion was heated until a system temperature would become 75° C. and was then allowed to react for 5 hours. Thirty parts of a 1% aqueous ammonium persulfate solution was added to the resultant and then aged at 75° C. for 5 hours to obtain [Particle dispersion liquid], i.e., an aqueous dispersion liquid of a vinyl resin (a copolymer of styrene/methacrylic acid/sodium salt of sulfuric acid ester of methacrylic acid ethylene oxide adduct).

The [Particle dispersion liquid] was found to have the volume average particle diameter of 0.14 μm as measured by means of LA-920 (available from HORIBA, Ltd.).

<Preparation of Aqueous Phase>

Water (990 parts), 83 parts of the [Particle dispersion liquid], 37 parts of a 48.5% aqueous solution of sodium dodecyl diphenyl ether disulfonate (ELEMINOL MON-7, available from Sanyo Chemical Industries Ltd.), and 90 parts of ethyl acetate were mixed and stirred to obtain a milky white liquid, which was used as [Aqueous phase].

<Emulsification and Desolvation>

The [Aqueous phase] (1,200 parts) was added to a vessel including the [Oil phase]. The resultant mixture was mixed by means of a TK Homomixer at 13,000 rpm for 20 min to obtain [Emulsified slurry].

A vessel to which a stirring bar and a thermometer had been set was charged with the [Emulsified slurry], desolvated at 30° C. for 8 hours, and then aged at 45° C. for 4 hours to obtain [Dispersion slurry].

<Washing and Drying>

One hundred parts of the [Dispersion slurry] was filtrated under reduced pressure, and then the resultant was subjected twice to a series of procedures (1) to (4) described below to obtain [Filtration cake]:

(1): 100 parts of ion-exchanged water was added to the resultant filtration cake, mixed with a TK Homomixer (at 12,000 rpm for 10 min), and then filtrated;

(2): 100 parts of a 10% aqueous sodium hydroxide solution was added to the filtration cake obtained in (1), mixed with the TK Homomixer (at 12,000 rpm for 30 min), and then filtrated under reduced pressure;

(3): 100 parts of 10% hydrochloric acid was added to the filtration cake obtained in (2), mixed with the TK Homomixer (at 12,000 rpm for 10 min), and then filtrated; and (4): 300 parts of ion-exchanged water was added to the filtration cake obtained in (3), mixed with the TK Homomixer (at 12,000 rpm for 10 min), and then filtrated.

The [Filtration cake] was dried with an air-circulating drier at 45° C. for 48 hours, and then was sieved through a 75-μm mesh to prepare [Toner base particles 1].

<External Addition Treatment>

In HENSCHEL MIXER, 100 parts of the Toner base particles 1, 0.6 parts of hydrophobic silica having an average particle diameter of 100 nm, 1.0 part of titanium oxide having an average particle diameter of 20 nm, and 0.8 parts of hydrophobic silica powder having an average particle diameter of 15 nm were mixed together, to obtain Toner 1.

Examples 2 to 25 and Comparative Examples 1 to 4

Toners 2 to 29 of Examples 2 to 25 and Comparative Examples 1 to 4 were obtained in the same manner as in Example 1, except that Resin A to Resin C described in columns of Examples 2 to 25 and Comparative Examples 1 to 4 in Tables 1-1 to 1-4 were used as resins corresponding to the Prepolymer A-1, the non-crystalline polyester resin B-1, and the crystalline polyester resin C, which were used in Example 1, at component ratios described in the columns. Note that, the Resin C was not used in Examples 11 and 12.

<Production of Carrier>

To 100 parts of toluene, 100 parts of a silicone resin (organo straight silicone), 5 parts of γ-(2-aminoethyl)aminopropyltrimethoxy silane, and 10 parts of carbon black were added. The materials were dispersed by means of a homomixer for 20 min to prepare a resin-layer-coating liquid. The resin-layer-coating liquid was coated onto surfaces of spherical magnetite particles having an average particle diameter of 50 m (1,000 parts) by means of a fluidized-bed-coating device to produce a carrier.

<Production of Developer>

Each (5 parts) of the toners and the carrier (95 parts) were mixed by means of a ball mill to produce developers.

The toners or the developers were evaluated for properties in the following manners. Results are presented in Tables 1-1 to 1-4.

<Low-Temperature Fixing Ability and Hot Offset Resistance>

A unit of IMAGEO MP C4300 (available from Ricoh Company, Ltd.) was charged with each of the developers, and then a rectangular solid image having a size of 2 cm×15 cm was formed on A4-size, long-grain PPC sheets TYPE 6000<70W> (available from Ricoh Company, Ltd.) so as to give a toner deposition amount of 0.40 mg/cm$^2$.

During the solid image formation, a surface temperature of a fixing roller was varied to observe whether an offset occurred, that is, whether a residual developed image of the solid image was fixed on an unwanted position. Low-temperature fixing ability and hot offset resistance were evaluated according to the following criteria.

[Criteria for Evaluation of Low-Temperature Fixing Ability]

A: Lower than 110° C.

B: 110° C. or higher but lower than 120° C.

C: 120° C. or higher but lower than 130° C.

D: 130° C. or higher

[Criteria for Evaluation of Hot Offset Resistance]

A: 170° C. or higher

B: 160° C. or higher but lower than 170° C.

C: 150° C. or higher but lower than 160° C.

D: Lower than 150° C.

<Heat-Resistant Storage Stability>

A 50 mL glass container was filled with each of the toners, left to stand in a thermostat bath set to 50° C. for 24 hours, and then cooled to 24° C. Next, penetration [mm] of the toner was measured according to a penetration test (JIS K2235-1991) and evaluated for heat-resistant storage stability according to the following criteria.

[Evaluation Criteria]

A: The penetration was 20 mm or greater.

B: The penetration was 15 mm or greater but less than 20 mm.

C: The penetration was 10 mm or greater but less than 15 mm.

D: The penetration was less than 10 mm.

<Moisture-and-Heat-Resistant Storage Stability>

Each of the toners was stored at 40° C. and 70% RH for 3 days and then sieved through a 42-mesh sieve for 2 min. A residual rate of the toner remaining on a metal mesh was measured and evaluated according to the following criteria. The better the heat-resistant storage stability of the toner is, the lower the residual rate is.

[Evaluation Criteria]

A: The residual rate was lower than 10%.

B: The residual rate was 10% or higher but lower than 20%.

C: The residual rate was 20% or higher but lower than 30%.

D: The residual rate was 30% or higher.

<Glossiness>

A modified apparatus obtained by modifying a fixing portion of a copier, MF2200 (available from Ricoh Company, Ltd.) employing a TEFLON (registered trademark) roller as a fixing roller was used to perform a copying test on sheets of Type 6200 paper (available from Ricoh Company, Ltd.). Specifically, the fixing temperature was set to a temperature higher by 20° C. than the fixing lower-limit temperature determined in the evaluation of the low-temperature fixing ability, and the paper-feeding linear velocity was set to be from 120 mm/sec through 150 mm/sec, the surface pressure was set to 1.2 kgf/cm$^2$, and the nip width was set to 3 mm. Images obtained in the copying test were measured for 60-degree glossiness (%) by a glossmeter VG-7000 (available from NIPPON DENSHOKU INDUSTRIES Co., Ltd.) and evaluated according to the following evaluation criteria.

[Evaluation Criteria]

A: 30% or more

B: 25% or more but less than 30%

C: 20% or more but less than 25%

D: less than 20%

<Image Intensity>

A unit of IMAGEO MP C4300 (available from Ricoh Company, Ltd.) was charged with each of the developers, and then a rectangular solid image having a size of 2 cm×15 cm was formed on A4-size, long-grain PPC sheets TYPE 6000<70W> (available from Ricoh Company, Ltd.) so as to give a toner deposition amount of 0.4 mg/cm$^2$. During the solid image formation, a fixing temperature was set to a temperature higher by 10° C. than the fixing lower-limit temperature determined in the evaluation of the low-temperature fixing ability. Surfaces of the resultant output images (character images) were rubbed 50 times at a load of 800 g with sheets of recycled paper (recycled paper of a resource type A, available from NBS Ricoh Company Ltd.) by means of an S type friction tester (SUTHERLAND2000 RUB TESTER, available from Danilee Co.). The degree of scratches on the surface of the image was ranked from comparison with samples for ranking.

[Evaluation Criteria]

AA: There was almost no change in glossiness and there was no scratch.

A: There was slight change in glossiness but there was almost no scratch visually recognizable.

B: There was change in glossiness and there were a few scratches.

C: There was great change in glossiness and there were noticeable scratches.

D: There were noticeable scratches and an underlying sheet of transfer paper was slightly visible.

TABLE 1-1

| | | Ex. 1 | Ex. 2 | Ex. 3 | Ex. 4 | Ex. 5 | Ex. 6 | Ex. 7 | Ex. 8 |
|---|---|---|---|---|---|---|---|---|---|
| Toner No. | | 1 | 2 | 3 | 4 | 5 | 6 | 7 | 8 |
| Non-crystalline polyester resin A | Kind | A-1 | A-1 | A-1 | A-1 | A-2 | A-1 | A-1 | A-1 |
| | Diol | 3-MPG 100% | 3-MPG 100% | 3-MPG 100% | 3-MPG 100% | 3-MPG 97%/ TMP 3% | 3-MPG 100% | 3-MPG 100% | 3-MPG 100% |
| | Dicarboxylic acid | AA 50%/ TPA 50% | AA 50%/ TPA 50% | AA 50%/ TPA 50% | AA 50%/ TPA 50% | AA 50%/ TPA 50% | AA 50%/ TPA 50% | AA 50%/ TPA 50% | AA 50%/ TPA 50% |
| | Cross-linking agent | TMP | TMP | TMP | TMP | TMP | TMP | TMP | TMP |
| | OH/COOH | 1.1 | 1.1 | 1.1 | 1.1 | 1.05 | 1.1 | 1.1 | 1.1 |
| | Tg (° C.) | −35 | −35 | −35 | −35 | −32 | −35 | −35 | −35 |
| | Mw | 25,000 | 25,000 | 25,000 | 25,000 | 30,000 | 25,000 | 25,000 | 25,000 |
| Non-crystalline polyester resin B | Kind | B-1 | B-2 | B-3 | B-4 | B-4 | B-5 | B-6 | B-7 |
| | Diol | BisA-EO 60%/PG 40% | BisA-EO 50%/PG 50% | BisA-EO 25%/PG 75% | PG 100% | PG 100% | PG 100% | PG 100% | BisA-PO 33%/PG 67% |
| | Dicarboxylic acid | TPA 80%/ AA 20% | TPA 80%/ AA 20% | TPA 80%/ AA 20% | TPA 80%/ AA 20% | TPA 80%/ AA 20% | TPA 85%/ AA 15% | TPA 100% | TPA 100% |
| | OH/COOH | 1.10 | 1.10 | 1.10 | 1.10 | 1.10 | 1.10 | 1.38 | 1.22 |
| | Tg (° C.) | 61 | 58 | 55 | 49 | 49 | 63 | 65 | 68 |
| | Mw | 20,900 | 20,800 | 20,500 | 16,300 | 16,300 | 22,500 | 5,300 | 6,800 |
| | SPb | 11.33 | 11.37 | 11.47 | 11.66 | 11.66 | 11.73 | 11.94 | 11.63 |
| Crystalline polyester resin C | Kind | C-1 | C-1 | C-1 | C-1 | C-1 | C-1 | C-1 | C-1 |
| | Diol | HD 100% | HD 100% | HD 100% | HD 100% | HD 100% | HD 100% | HD 100% | HD 100% |
| | Dicarboxylic acid | SA 100% | SA 100% | SA 100% | SA 100% | SA 100% | SA 100% | SA 100% | SA 100% |
| | OH/COOH | 0.90 | 0.90 | 0.90 | 0.90 | 0.90 | 0.90 | 0.90 | 0.90 |
| | Melting point (° C.) | 67 | 67 | 67 | 67 | 67 | 67 | 67 | 67 |
| | Mw | 25,000 | 25,000 | 25,000 | 25,000 | 25,000 | 25,000 | 25,000 | 25,000 |
| | SPc | 9.85 | 9.85 | 9.85 | 9.85 | 9.85 | 9.85 | 9.85 | 9.85 |
| | ΔSP value (SPb − SPc) | 1.48 | 1.52 | 1.62 | 1.81 | 1.81 | 1.88 | 2.09 | 1.78 |
| Component ratio (% by mass) | Resin A | 150 | 150 | 150 | 180 | 120 | 150 | 120 | 120 |
| | Resin B | 750 | 750 | 750 | 720 | 780 | 750 | 780 | 780 |
| | Resin C | 50 | 50 | 50 | 50 | 50 | 50 | 50 | 50 |
| | Release agent | 50 | 50 | 50 | 50 | 50 | 50 | 50 | 50 |
| | Colorant | 50 | 50 | 50 | 50 | 50 | 50 | 50 | 50 |
| Physical property of toner | Tg1st of toner (° C.) | 40 | 38 | 36 | 28 | 35 | 41 | 47 | 49 |
| | Tg2nd of toner (° C.) | 20 | 19 | 15 | 11 | 18 | 21 | 22 | 24 |
| | Storage modulus at 60° C. during cooling (×10$^6$) (Pa) | 8.6 | 8.4 | 8.3 | 3.1 | 12 | 8.7 | 18 | 21 |
| Quality of toner | Low-temperature fixing ability | B | A | A | A | A | A | A | B |
| | Hot offset resistance | A | A | A | A | A | B | B | B |
| | Heat-resistant storage stability | B | B | B | B | B | B | B | B |
| | Moisture-and-heat-resistant storage stability | B | B | A | B | A | A | A | A |
| | Glossiness | B | B | B | A | B | B | A | A |
| | Image density | A | B | B | B | A | B | A | A |

TABLE 1-2

| | | Ex. 9 | Ex. 10 | Ex. 11 | Ex. 12 | Ex. 13 | Ex. 14 | Ex. 15 | Ex. 16 |
|---|---|---|---|---|---|---|---|---|---|
| Toner No. | | 9 | 10 | 11 | 12 | 13 | 14 | 15 | 16 |
| Non-crystalline polyester resin A | Kind | A-1 | A-1 | A-1 | A-3 | A-4 | A-5 | A-6 | A-1 |
| | Diol | 3-MPG 100% | 3-MPG 100% | 3-MPG 100% | 3-MPG 100% | PD 100% | 2-MPD 50%/4-MHD 50% | 5-MND 100% | 3-MPG 100% |
| | Dicarboxylic acid | AA 50%/ TPA 50% | AA 50%/ TPA 50% | AA 50%/ TPA 50% | AA 50%/ TPA 50% | AA 50%/ TPA 50% | AA 50%/ TPA 50% | AA 50%/ TPA 50% | AA 50%/ TPA 50% |
| | Cross-linking agent | TMP | TMP | TMP | PE | TMP | TMP | TMP | TMP |
| | OH/COOH | 1.1 | 1.1 | 1.1 | 1.1 | 1.1 | 1.1 | 1.1 | 1.1 |
| | Tg (° C.) | −35 | −35 | −35 | −33 | −15 | −35 | −50 | −35 |
| | Mw | 25,000 | 25,000 | 25,000 | 26,000 | 28,000 | 26,000 | 29,000 | 25,000 |
| Non-crystalline polyester resin B | Kind | B-7 | B-7 | B-7 | B-7 | B-9 | B-10 | B-1 | B-4 |
| | Diol | BisA-PO 33%/PG 67% | BisA-PO 33%/PG 67% | BisA-PO 33%/PG 67% | BisA-PO 33%/PG 67% | BisA-PO 33%/PD 67% | BisA-PO 33%/BD 67% | BisA-EO 60%/PG 40% | PG 100% |
| | Dicarboxylic acid | TPA 100% | TPA 100% | TPA 100% | TPA 100% | TPA 100% | TPA 100% | TPA 80%/ AA 20% | TPA 80%/ AA 20% |
| | OH/COOH | 1.22 | 1.22 | 1.22 | 1.22 | 1.22 | 1.22 | 1.10 | 1.10 |
| | Tg (° C.) | 68 | 68 | 68 | 68 | 65 | 50 | 61 | 49 |
| | Mw | 6,800 | 6,800 | 6,800 | 6,800 | 7,000 | 7,200 | 20,900 | 16,300 |
| | SPb | 11.63 | 11.63 | 11.63 | 11.63 | 11.67 | 11.32 | 11.33 | 11.66 |
| Crystalline polyester resin C | Kind | C-1 | C-1 | — | — | C-1 | C-1 | C-1 | C-1 |
| | Diol | HD 100% | HD 100% | — | — | HD 100% | HD 100% | HD 100% | HD 100% |
| | Dicarboxylic acid | SA 100% | SA 100% | — | — | SA 100% | SA 100% | SA 100% | SA 100% |
| | OH/COOH | 0.90 | 0.90 | — | — | 0.90 | 0.90 | 0.90 | 0.90 |
| | Melting point (° C.) | 67 | 67 | — | — | 67 | 67 | 67 | 67 |
| | Mw | 25,000 | 25,000 | — | — | 25,000 | 25,000 | 25,000 | 25,000 |
| | SPc | 9.85 | 9.85 | — | — | 9.85 | 9.85 | 9.85 | 9.85 |
| | ΔSP value (SPb − SPc) | 1.78 | 1.78 | — | — | 1.82 | 1.47 | 1.48 | 1.81 |
| Component ratio (% by mass) | Resin A | 180 | 150 | 150 | 150 | 150 | 150 | 150 | 150 |
| | Resin B | 720 | 750 | 750 | 750 | 750 | 750 | 750 | 750 |
| | Resin C | 50 | 50 | 0 | 0 | 50 | 50 | 50 | 50 |
| | Release agent | 50 | 50 | 50 | 50 | 50 | 50 | 50 | 50 |
| | Colorant | 50 | 50 | 50 | 50 | 50 | 50 | 50 | 50 |
| Physical property of toner | Tg1st of toner (° C.) | 41 | 45 | 45 | 46 | 48 | 32 | 40 | 31 |
| | Tg2nd of toner (° C.) | 21 | 23 | 29 | 30 | 20 | 20 | 20 | 15 |
| | Storage modulus at 60° C. during cooling ($\times 10^6$) (Pa) | 4.9 | 9.4 | 9.3 | 9.4 | 9.1 | 8.1 | 8.4 | 8.2 |
| Quality of toner | Low-temperature fixing ability | A | A | B | B | B | A | A | A |
| | Hot offset resistance | A | A | A | A | A | B | B | A |
| | Heat-resistant storage stability | B | A | A | A | A | B | B | B |
| | Moisture-and-heat-resistant storage stability | B | A | A | A | B | B | B | B |
| | Glossiness | A | A | B | B | B | B | B | B |
| | Image density | B | A | A | A | B | A | A | B |

TABLE 1-3

| | | Ex. 17 | Ex. 18 | Ex. 19 | Ex. 20 | Ex. 21 | Ex. 22 | Ex. 23 | Ex. 24 | Ex. 25 |
|---|---|---|---|---|---|---|---|---|---|---|
| Toner No. | | 17 | 18 | 19 | 20 | 21 | 22 | 23 | 24 | 25 |
| Non-crystalline polyester resin A | Kind | A-7 | A-8 | A-9 | A-10 | A-1 | A-11 | A-1 | A-11 | A-1 |
| | Diol | 3-MPG 100% | 3-MPG 100% | 3-MPG 100% | 3-MPG 100% | 3-MPG 100% | 5-MND 100% | 3-MPG 100% | 5-MND 100% | 3-MPG 100% |
| | Dicarboxylic acid | AA 60%/ TPA 40% | AA 40%/ TPA 60% | SuA 60%/ TPA 40% | SA 33%/ TPA 67% | AA 50%/ TPA 50% | AA 30%/ TPA 70% | AA 50%/ TPA 50% | AA 30%/ TPA 70% | AA 50%/ TPA 50% |
| | Cross-linking agent | TMP | TMP | TMP | TMP | TMP | TMP | TMP | TMP | TMP |
| | OH/COOH | 1.1 | 1.1 | 1.1 | 1.1 | 1.1 | 1.1 | 1.1 | 1.1 | 1.1 |
| | Tg (° C.) | −40 | −32 | −30 | −38 | −35 | −38 | −35 | −38 | −35 |
| | Mw | 24,000 | 26,000 | 19,000 | 28,000 | 25,000 | 25,000 | 25,000 | 25,000 | 25,000 |
| Non-crystalline polyester resin B | Kind | B-4 | B-4 | B-1 | B-1 | B-7 | B-13 | B-13 | B-14 | B-14 |
| | Diol | PG 100% | PG 100% | BisA-EO 60%/PG 40% | BisA-EO 60%/PG 40% | BisA-PO 33%/PG 67% | BisA-EO 60%/PG 40% | BisA-EO 60%/PG 40% | BisA-EO 10%/PG 90% | BisA-EO 10%/PG 90% |
| | Dicarboxylic acid | TPA 80%/ AA 20% | TPA 80%/ AA 20% | TPA 80%/ AA 20% | TPA 80%/ AA 20% | TPA 100% | TPA 70%/ SuA 30% | TPA 70%/ SuA 30% | TPA 80%/ SA 20% | TPA 80%/ SA 20% |
| | OH/COOH | 1.10 | 1.10 | 1.10 | 1.10 | 1 | 1.10 | 1.10 | 1.10 | 1.10 |
| | Tg (° C.) | 49 | 49 | 61 | 61 | 68 | 60 | 60 | 47 | 47 |

TABLE 1-3-continued

| | | Ex. 17 | Ex. 18 | Ex. 19 | Ex. 20 | Ex. 21 | Ex. 22 | Ex. 23 | Ex. 24 | Ex. 25 |
|---|---|---|---|---|---|---|---|---|---|---|
| | Mw | 16,300 | 16,300 | 20,900 | 20,900 | 6,800 | 20,900 | 20,900 | 20,900 | 20,900 |
| | SPb | 11.66 | 11.66 | 11.33 | 11.33 | 11.63 | 11.35 | 11.35 | 11.37 | 11.37 |
| Crystalline polyester resin C | Kind | C-1 | C-1 | C-1 | C-1 | C-2 | C-1 | C-1 | C-1 | C-1 |
| | Diol | HD 100% | HD 100% | HD 100% | HD 100% | EG 100% | HD 100% | HD 100% | HD 100% | HD 100% |
| | Dicarboxylic acid | SA 100% | SA 100% | SA 100% | SA 100% | SA 100% | SA 100% | SA 100% | SA 100% | SA 100% |
| | OH/COOH | 0.90 | 0.90 | 0.90 | 0.90 | 0.90 | 0.90 | 0.90 | 0.90 | 0.90 |
| | Melting point (° C.) | 67 | 67 | 67 | 67 | 81 | 67 | 67 | 67 | 67 |
| | Mw | 25,000 | 25,000 | 25,000 | 25,000 | 20,000 | 25,000 | 25,000 | 25,000 | 25,000 |
| | SPc | 9.85 | 9.85 | 9.85 | 9.85 | 10.24 | 9.85 | 9.85 | 9.85 | 9.85 |
| | ΔSP value (SPb − SPc) | 1.81 | 1.81 | 1.48 | 1.48 | 1.39 | 1.50 | 1.50 | 1.52 | 1.52 |
| Component ratio (% by mass) | Resin A | 150 | 250 | 150 | 150 | 150 | 150 | 150 | 150 | 150 |
| | Resin B | 750 | 650 | 750 | 750 | 750 | 750 | 750 | 750 | 750 |
| | Resin C | 50 | 50 | 50 | 50 | 50 | 50 | 50 | 50 | 50 |
| | Release agent | 50 | 50 | 50 | 50 | 50 | 50 | 50 | 50 | 50 |
| | Colorant | 50 | 50 | 50 | 50 | 50 | 50 | 50 | 50 | 50 |
| Physical property of toner | Tg1st of toner (° C.) | 30 | 21 | 41 | 39 | 47 | 38 | 40 | 39 | 40 |
| | Tg2nd of toner (° C.) | 12 | 1 | 26 | 23 | 26 | 19 | 20 | 18 | 19 |
| | Storage modulus at 60° C. during cooling ($\times 10^6$) (Pa) | 8.0 | 1.2 | 8.6 | 8.7 | 9.2 | 8.8 | 9.0 | 8.1 | 8.3 |
| Quality of toner | Low-temperature fixing ability | A | B | B | B | A | B | B | A | A |
| | Hot offset resistance | A | A | A | A | A | A | A | A | A |
| | Heat-resistant storage stability | B | C | B | B | A | B | A | B | A |
| | Moisture-and-heat-resistant storage stability | B | B | B | B | A | B | A | B | A |
| | Glossiness | B | B | B | B | A | B | B | B | B |
| | Image density | B | C | A | A | AA | B | B | B | B |

TABLE 1-4

| | | Comp. Ex. 1 | Comp. Ex. 2 | Comp. Ex. 3 | Comp. Ex. 4 |
|---|---|---|---|---|---|
| | Toner No. | 26 | 27 | 28 | 29 |
| Non-crystalline polyester resin A | Kind | A-1 | A-1 | A-1 | A-1 |
| | Diol | 3-MPG 100% | 3-MPG 100% | 3-MPG 100% | 3-MPG 100% |
| | Dicarboxylic acid | AA 50%/ TPA 50% | AA 50%/ TPA 50% | AA 50%/ TPA 50% | AA 50%/ TPA 50% |
| | Cross-linking agent | TMP | TMP | TMP | TMP |
| | OH/COOH | 1.1 | 1.1 | 1.1 | 1.1 |
| | Tg (° C.) | −35 | −35 | −35 | −35 |
| | Mw | 25,000 | 25,000 | 25,000 | 25,000 |
| Non-crystalline polyester resin B | Kind | B-8 | B-4 | B-11 | B-12 |
| | Diol | BisA-PO 60%/ BisA-EO 40% | PG 100% | BisA-EO 65%/PG 35% | BisA-EO 87%/PG 13% |
| | Dicarboxylic acid | TPA 95%/ AA 5% | TPA 80%/ AA 20% | TPA 80%/ AA 20% | TPA 20%/ AA 80% |
| | OH/COOH | 1.25 | 1.10 | 1.08 | 1.20 |
| | Tg (° C.) | 70 | 49 | 65 | 29 |
| | Mw | 8,700 | 16,300 | 24,500 | 12,000 |
| | SPb | 11.11 | 11.66 | 11.32 | 10.88 |
| Crystalline polyester resin C | Kind | C-1 | C-1 | C-1 | C-1 |
| | Diol | HD 100% | HD 100% | HD 100% | HD 100% |
| | Dicarboxylic acid | SA 100% | SA 100% | SA 100% | SA 100% |
| | OH/COOH | 0.90 | 0.90 | 0.90 | 0.90 |
| | Melting point (° C.) | 67 | 57 | 67 | 57 |
| | Mw | 25,000 | 25,000 | 25,000 | 25,000 |
| | SPc | 9.85 | 9.85 | 9.85 | 9.85 |
| | ΔSP value (SPb − SPc) | 1.26 | 1.81 | 1.47 | 1.03 |
| Component ratio (% by mass) | Resin A | 120 | 270 | 120 | 150 |
| | Resin B | 780 | 630 | 780 | 750 |
| | Resin C | 50 | 50 | 50 | 50 |
| | Release agent | 50 | 50 | 50 | 50 |
| | Colorant | 50 | 50 | 50 | 50 |
| Physical property of toner | Tg1st of toner (° C.) | 51 | 18 | 47 | 16 |
| | Tg2nd of toner (° C.) | 31 | −1 | 31 | 2 |
| | Storage modulus at 60° C. during cooling ($\times 10^6$) (Pa) | 21 | 1.1 | 17 | 5.6 |
| Quality of toner | Low-temperature fixing ability | B | B | C | B |
| | Hot offset resistance | B | A | B | C |

TABLE 1-4-continued

| | Comp. Ex. 1 | Comp. Ex. 2 | Comp. Ex. 3 | Comp. Ex. 4 |
|---|---|---|---|---|
| Heat-resistant storage stability | C | C | C | C |
| Moisture-and-heat-resistant storage stability | C | C | C | D |
| Glossiness | B | C | B | B |
| Image density | A | D | A | B |

Means of abbreviations in Tables 1-1 to 1-4 are as follows.
3-MPG: 3-methyl-1,5-pentanediol
TMP: trimethylolpropane
AA: adipic acid
TPA: terephthalic acid
PE: pentaerythritol
BisA-EO: bisphenol A ethylene oxide 2 mol adduct
BisA-PO: bisphenol A propylene oxide 2 mol adduct
PG: 1,2-propylene glycol
HD: 1,6-hexanediol
SA: sebacic acid
SuA: succinic acid
PD: 1,3-propanediol
BD: 1,4-butanediol
2-MPD: 2-methyl-1,3-propanediol
4-MHD: 4-methyl-1,7-heptanediol
5-MND: 5-methyl-1,9-nonanediol
EG: ethylene glycol Aspects of the present invention are as follows, for example.

<1> A toner including:
a pigment;
polyester resin A that is insoluble in tetrahydrofuran (THF); and
polyester resin B that is soluble in THF,
wherein the toner satisfies requirements (1) to (3) below:
(1) the polyester resin A includes one or more aliphatic diols including from 3 through 10 carbon atoms, as a component constituting the polyester resin A;
(2) the polyester resin B includes at least an alkylene glycol in an amount of 40 mol % or more, as a component constituting the polyester resin B; and
(3) a glass transition temperature (Tg1st) of the toner at first heating in differential scanning calorimetry (DSC) of the toner is from 20° C. through 50° C.

<2> The toner according to <1>,
wherein the polyester resin A includes a trivalent or tetravalent aliphatic alcohol, as a cross-linking component constituting the polyester resin A.

<3> The toner according to <1> or <2>,
wherein the polyester resin A includes a diol component including a main chain portion having an odd number of carbon atoms, and wherein the diol component includes an alkyl group in a side chain.

<4> The toner according to any one of <1> to <3>, further including
crystalline polyester resin C.

<5> The toner according to any one of <1> to <4>,
wherein the toner has a storage modulus of $8.0\times10^6$ Pa or more at 60° C. during cooling after heated to 100° C.

<6> The toner according to <4>,
wherein the polyester resin B and the crystalline polyester resin C satisfy $1.2<SPb-SPc<1.5$ where SPb denotes a solubility parameter [$cal^{1/2}/cm^{3/2}$] of the polyester resin B and SPc denotes a solubility parameter [$cal^{1/2}/cm^{3/2}$] of the crystalline polyester resin C.

<7> The toner according to any one of <1> to <6>,
wherein the polyester resin A includes a dicarboxylic acid component, as a component constituting the polyester resin A, wherein the dicarboxylic acid component includes an aliphatic dicarboxylic acid including from 4 through 12 carbon atoms.

<8> The toner according to any one of <1> to <7>,
wherein the polyester resin A includes at least one of a urethane bond and a urea bond.

<9> The toner according to any one of <1> to <8>,
wherein a glass transition temperature (Tg2nd) of the toner at second heating in differential scanning calorimetry (DSC) is from 0° C. through 30° C., and
wherein the Tg1st and the Tg2nd satisfy an expression of Tg1st>Tg2nd.

<10> The toner according to any one of <1> to <9>,
wherein the polyester resin B includes 1,2-propylene glycol, as a component constituting the polyester resin B.

<11> A developer including:
the toner according to any one of <1> to <10>; and
a carrier.

<12> An image forming apparatus including:
an electrostatic latent image bearer;
an electrostatic latent image forming means configured to form an electrostatic latent image on the electrostatic latent image bearer; and
a developing means including a toner and configured to develop the electrostatic latent image formed on the electrostatic latent image bearer to form a visible image,
wherein the toner is the toner according to any one of <1> to <10>.

DESCRIPTION OF THE REFERENCE NUMERAL

10 electrostatic latent image bearer (photoconductor drum)
10K black-electrostatic-latent image bearer
10Y yellow-electrostatic-latent image bearer
10M magenta-electrostatic-latent image bearer
10C cyan-electrostatic-latent image bearer
14 support roller
15 support roller
16 support roller
17 cleaning device for intermediate transfer member
18 image forming means
20 charging roller
21 exposure device
22 secondary transfer device
23 roller
24 secondary transfer belt
25 fixing device
26 fixing belt
27 press roller
28 sheet inverting device
30 exposure device
32 contact glass

33 first travelling body
34 second travelling body
35 imaging forming lens
36 reading sensor
40 developing device
41 developing belt
42K developer stored container
42Y developer stored container
42M developer stored container
42C developer stored container
43K developer supply roller
43Y developer supply roller
43M developer supply roller
43C developer supply roller
44K developing roller
44Y developing roller
44M developing roller
44C developing roller
45K black developing unit
45Y yellow developing unit
45M magenta developing unit
45C cyan developing unit
49 registration roller
50 intermediate transfer belt
51 roller
52 separation roller
53 manual paper feeding path
54 manual paper feeding tray
55 switching claw
56 ejection roller
57 paper ejection tray
58 corona charging device
60 cleaning device
61 developing device
62 transfer roller
63 cleaning device for photoconductor
64 charge-eliminating lamp
70 charge-eliminating lamp
80 transfer roller
90 cleaning device
95 transfer paper
100A image forming apparatus
100B image forming apparatus
100C image forming apparatus
110 process cartridge
120 image forming unit
130 document table
142 paper feeding roller
143 paper bank
144 paper feeding cassette
145 separation roller
146 paper feeding path
147 conveying roller
148 paper feeding path
150 copier main body
160 charging device
200 paper feeding table
300 scanner
400 automatic document feeder (ADF)
L light

The invention claimed is:

1. A toner, comprising:
a pigment;
polyester resin A that is insoluble in tetrahydrofuran (THF); and
polyester resin B that is soluble in THF,
wherein the toner satisfies (1) to (3):
(1) the polyester resin A includes one or more aliphatic diols including from 3 through 10 carbon atoms, as a component constituting the polyester resin A;
(2) the polyester resin B includes at least an alkylene glycol in an amount of 40 mol % or more, as a component constituting the polyester resin B; and
(3) a glass transition temperature (Tg1st) of the toner at first heating in differential scanning calorimetry (DSC) of the toner is from 20° C. through 50° C.

2. The toner according to claim 1, wherein the polyester resin A comprises a trivalent or tetravalent aliphatic alcohol, as a cross-linking component constituting the polyester resin A.

3. The toner according to claim 1,
wherein the polyester resin A comprises a diol component including a main chain portion having an odd number of carbon atoms, and
wherein the diol component includes an alkyl group in a side chain.

4. The toner according to claim 1, further comprising crystalline polyester resin C.

5. The toner according to claim 4, wherein the polyester resin B and the crystalline polyester resin C satisfy $1.2<SPb-SPc<1.5$ where SPb denotes a solubility parameter $[cal^{1/2}/cm^{3/2}]$ of the polyester resin B and SPc denotes a solubility parameter $[cal^{1/2}/cm^{3/2}]$ of the crystalline polyester resin C.

6. The toner according to claim 4, wherein the crystalline polyester resin C is included in an amount of from 3 to 20 parts by mass relative to 100 parts by mass of the toner.

7. The toner according to claim 4, wherein the polyester resin B is included in an amount of from 60 to 80 parts by mass, and the crystalline polyester resin C is included in an amount of from 5 to 15 parts by mass, relative to 100 parts by mass of the toner.

8. The toner according to claim 1, wherein the toner has a storage modulus of $8.0\times10^6$ Pa or more at 60° C. during cooling after heated to 100° C.

9. The toner according to claim 1,
wherein the polyester resin A includes a dicarboxylic acid component, as a component constituting the polyester resin A,
wherein the dicarboxylic acid component includes an aliphatic dicarboxylic acid including from 4 through 12 carbon atoms.

10. The toner according to claim 1, wherein the polyester resin A includes at least one of a urethane bond and a urea bond.

11. The toner according to claim 1,
wherein a glass transition temperature (Tg2nd) of the toner at second heating in differential scanning calorimetry (DSC) is from 0° C. through 30° C., and
wherein the Tg1st and the Tg2nd satisfy an expression of Tg1st>Tg2nd.

12. The toner according to claim 1, wherein the polyester resin B includes 1,2-propylene glycol, as a component constituting the polyester resin B.

13. A developer comprising:
the toner according to claim 1; and
a carrier.

14. An image forming apparatus, comprising:
an electrostatic latent image bearer;
an electrostatic latent image former configured to form an electrostatic latent image on the electrostatic latent image bearer; and a developer including the toner of claim 1 and configured to develop the electrostatic latent image formed on the electrostatic latent image bearer to form a visible image.

15. The toner according to claim 1, wherein the glass transition temperature (Tg1st) of the toner at first heating in differential scanning calorimetry (DSC) of the toner is from 41° C. through 50° C.

16. The toner according to claim 1, wherein the polyester resin B is included in an amount of from 50 to 90 parts by mass relative to 100 parts by mass of the toner.

17. The toner according to claim 1, wherein a mass ratio of the polyester resin A to the polyester resin B is from 120/780 to 250/650.

* * * * *